US009356336B1

(12) United States Patent
Zheng et al.

(10) Patent No.: US 9,356,336 B1
(45) Date of Patent: May 31, 2016

(54) DUAL-FOLDED MONOPOLE ANTENNA (DFMA)

(75) Inventors: Ming Zheng, Cupertino, CA (US); Joseph C. Modro, Palo Alto, CA (US)

(73) Assignee: Amazon Technologies Inc., Reno, NV (US)

( * ) Notice: Subject to any disclaimer, the term of this patent is extended or adjusted under 35 U.S.C. 154(b) by 865 days.

(21) Appl. No.: 13/495,189

(22) Filed: Jun. 13, 2012

(51) Int. Cl.
*H01Q 1/24* (2006.01)
*H01Q 9/30* (2006.01)
*H01Q 5/378* (2015.01)

(52) U.S. Cl.
CPC ..... *H01Q 1/243* (2013.01); *H01Q 5/378* (2015.01); *H01Q 9/30* (2013.01)

(58) Field of Classification Search
CPC ..... H01Q 1/243; H01Q 5/378; H01Q 5/385; H01Q 9/0421; H01Q 9/42; H01Q 1/38; H01Q 9/30
USPC ..... 343/702, 828, 829, 846, 848, 833, 834
See application file for complete search history.

(56) References Cited

U.S. PATENT DOCUMENTS

| | | | | |
|---|---|---|---|---|
| 7,026,999 | B2 * | 4/2006 | Umehara et al. | 343/702 |
| 7,136,022 | B2 * | 11/2006 | Sato et al. | 343/702 |
| 7,345,637 | B2 * | 3/2008 | Mizoguchi et al. | 343/702 |
| 7,791,546 | B2 * | 9/2010 | Hotta et al. | 343/702 |
| 7,825,863 | B2 * | 11/2010 | Martiskainen et al. | 343/702 |
| 8,779,987 | B2 * | 7/2014 | Endo et al. | 343/700 MS |
| 8,836,588 | B2 * | 9/2014 | Hayashi et al. | 343/702 |
| 8,988,292 | B2 * | 3/2015 | Hotta et al. | 343/702 |

* cited by examiner

*Primary Examiner* — Michael C Wimer
(74) *Attorney, Agent, or Firm* — Lowenstein Sandler LLP

(57) ABSTRACT

Methods and systems for extending a bandwidth of a dual-folded monopole antenna of a user device are described. A dual-folded monopole antenna includes a first folded monopole structure coupled to a single radio frequency (RF) input and a parasitic folded monopole structure coupled to a ground plane. The first folded monopole structure is configured to operate as a feeding structure to a parasitic folded monopole structure that is not conductively connected to the RF input.

21 Claims, 19 Drawing Sheets

DUAL-FOLDED MONOPOLE ANTENNA (DFMA)

BACKGROUND OF THE INVENTION

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops, and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high band. One resonant mode in the lower frequency band and one resonant mode in the high band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union. Application services include wide-area wireless voice telephone, mobile Internet access, video calls, and mobile TV, all in a mobile environment. The required frequency bands for 3G applications may be GSM850/EGSM in low band and DCS/PCS/WCDMA in high band. The 3G band is between 824 MHz and 960 MHz. Long Term Evolution (LTE) and LTE Advanced (sometimes generally referred to as 4G) are communication standards that have been standardized by the 3rd Generation Partnership Project (3GPP). However, in order to extend the frequency coverage down to 700 MHz for 4G/LTE application, antenna bandwidth needs to be increased especially in the low band. There are two common LTE bands used in the United States from 704 MHz-746 MHz (Band 17) and from 746 MHz-787 MHz (Band 13). Conventional solutions increase the antenna size or use active tuning elements to extend the bandwidth. Alternatively, conventional solutions use separate antennas to achieve different frequency bands and use a switch to switch between the antennas. These solutions are not conducive to use in user devices, often because of the size of the available space for antennas within the device.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION OF THE PRESENT INVENTION

Figure 1:
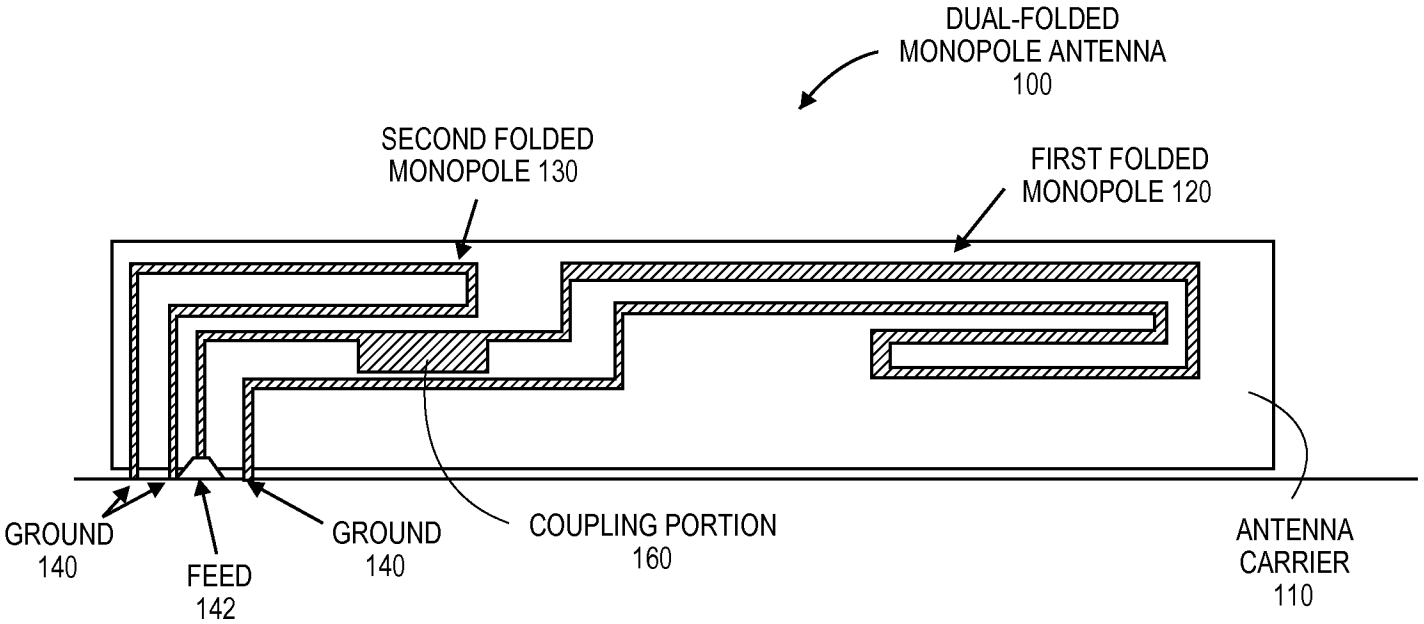
FIG. 1 illustrates one embodiment of a dual-folded monopole antenna including a first folded monopole structure and a second parasitic folded monopole structure.

Methods and systems for extending a bandwidth of a dual-folded monopole antenna of a user device are described. A dual-folded monopole antenna includes a first folded monopole structure coupled to a single radio frequency (RF) input and a parasitic folded monopole structure coupled to a ground plane. The first folded monopole structure is configured to operate as a feeding structure to a parasitic folded monopole structure that is not conductively connected to the RF feed. The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

As described above, the conventional antenna usually has only one resonant mode in the lower frequency band and one resonant mode in the high band. The embodiments described herein extend the bandwidth by using a dual-folded monopole antenna. The dual-folded monopole antenna is an ultra wideband antenna. The dual-folded monopole antenna has two folded monopoles, one being a driven folded monopole and the other being a parasitic folded monopole. In one embodiment, the dual-folded monopole antenna covers a frequency range between 700 MHz and 2.69 GHz. The dual-folded monopole antenna may provide a resonant mode for 4G/LTE applications, as well as additional resonances in the higher bands. In one embodiment, a dual-folded monopole antenna has a first folded monopole structure coupled to a single RF input and coupled to a ground plane, and the first folded monopole structure operates as a feeding structure to a parasitic folded monopole structure. The dual-folded monopole antenna has a single RF input that drives the first folded monopole structure as an active or driven element and the parasitic folded monopole structure as a parasitic element that is fed by the first folded monopole structure. By coupling the first folded monopole structure and the parasitic folded monopole structure, multiple resonant modes can be created in the low band and in the high band. The embodiments described herein are not limited to use in 3G and LTE bands, but could be used to increase the bandwidth of a multi-band frequency in other bands, such as Dual-band Wi-Fi, GPS, cellular, and Bluetooth frequency bands. The embodiments described herein provide a dual-folded monopole antenna to be coupled to a single RF input feed and does not use any active tuning to achieve the extended bandwidths. The embodiments described herein also provide a dual-folded monopole antenna with increased bandwidth in a size that is conducive to being used in a user device.

FIG. 1 illustrates one embodiment of a dual-folded monopole antenna 100 including a first folded monopole structure 120 and a second parasitic folded monopole structure 130. In this embodiment, the dual-folded monopole antenna 100 is fed at the single RF input 142 at the first folded monopole structure 120 and the parasitic folded monopole structure 130 is a parasitic element. A parasitic element is an element of the dual-folded monopole antenna 100 that is not driven directly by the single RF input 142. Rather, the single RF input 142 directly drives another element of the dual-folded monopole antenna (e.g., the first folded monopole structure 120), which parasitically induces a current on the parasitic element. In particular, by directly inducing current on the first folded monopole structure 120 by the single RF input 142, the directly-fed structure radiates electromagnetic energy, which causes another current on the parasitic folded monopole structure 130 to also radiate electromagnetic energy, creating multiple resonant modes. In the depicted embodiment, the parasitic folded monopole structure 130 is parasitic because it is physically separated from the first folded monopole structure 120 that is driven at the single RF input 142. It can also be said that the parasitic element 130 is not conductively connected to the RF input 142. The driven first folded monopole structure 120 parasitically excites the current flow of the parasitic folded monopole structure 130. In one embodiment, the parasitic folded monopole structure 130 and first folded monopole structure 120 can be physically separated by a gap. Alternatively, other antenna configurations may be used to include a driven element and a parasitic element. The dimensions of the first folded monopole structure 120 and the parasitic folded monopole structure 130 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another.

In FIG. 1, the ground is a radiation ground plane 140. The ground plane 140 may be a metal frame of the user device. The ground plane 140 may be a system ground or one of multiple grounds of the user device. The RF input 142 may be a feed line connector that couples the dual-folded monopole antenna 100 to a feed line (also referred to as the transmission line), which is a physical connection that carriers the RF signal to and/or from the dual-folded monopole antenna 100. The feed line connector may be any one of the three common types of feed lines, including coaxial feed lines, twin-lead lines, or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to first folded monopole structure 120 of the dual-folded monopole antenna 100, but is not conductively connected to the parasitic folded monopole structure 130 of the dual-folded monopole antenna 100. However, the first folded monopole structure 120 is configured to operate as a feeding structure to the parasitic folded monopole structure 130.

In one embodiment, the dual-folded monopole antenna 100 is disposed on an antenna carrier, such as a dielectric carrier of the user device. The antenna carrier may be any non-conductive material, such as dielectric material, upon which the conductive material of the dual-folded monopole antenna 100 can be disposed without making electrical contact with other metal of the user device. In another embodiment, portions of the dual-folded monopole antenna 100 may be disposed on or within a circuit board, such as a printed circuit board (PCB). Alternatively, the dual-folded monopole antenna 100 may be disposed on other components of the user device or within the user device as would be appreciated by one of ordinary skill in the art having the benefit of this disclosure. It should be noted that the dual-folded monopole antenna 100 illustrated in FIG. 1 is a planar, two-dimensional (2D) structure. However, as described herein, the dual-folded monopole antenna 100 may include 3D structures, as well as other variations than those depicted in FIG. 1. In one embodiment, the parasitic folded monopole structure 130, the first folded monopole structure 120, or both can be partially disposed on two or more sides of the antenna carrier. For example, the parasitic folded monopole structure 130 can be disposed on the front surface and the top surface of the antenna carrier. Alternatively, the first folded monopole structure 120 can be disposed on the front surface and the top surface of the antenna carrier. Similarly, portions of these elements can be disposed on sides of the antenna carrier as would be appreciated by one of ordinary skill in the art having the benefit of this disclosure.

Using the first folded monopole structure 120 and the parasitic folded monopole structure 130, the dual-folded monopole antenna 100 can create multiple resonant modes using the single RF input 142, such as three or more resonant modes. In one embodiment, the first folded monopole structure 120 and the parasitic folded monopole structure 130 are configured to extend a bandwidth of the dual-folded monopole antenna 100. In one embodiment, the dual-folded monopole antenna 100 has multiple resonant modes with frequencies between 700 MHz and 2.7 GHz. In another embodiment, the dual-folded monopole antenna 100 has multiple resonant modes with frequencies between 700 MHz and 6 GHz. In one embodiment, the first folded monopole structure 120 is configured to provide a first resonant mode, centered at 700 MHz, second resonate mode, centered at 900 MHz and third mode, centered at 2200 MHz. Whilst, the parasitic structure 130 is configured to provide a first resonant mode, centered at 1800 MHz, second resonate mode, centered at 1900 MHz. In another embodiment, the dual-folded monopole antenna 100 can be configured to create a resonant mode for LTE 700 plus resonant modes for penta-band. In telecommunications, the terms multi-band, dual-band, tri-band, quad-band, and penta-band refer to a device, such as the user device described herein, supporting multiple RF bands used for communication. In other embodiments, the antennas can be designed to cover an eight-band LTE/GSM/UMTS, the GSM850/900/1800/1900/UMTS penta-band operation, or the LTE700/GSM850/900 (698-960 MHz) and GSM 1800/190/UMTS/LTE2300/2500 (1710-2690) MHz operation. In the user device context, the purpose of doing so is to support roaming between different regions whose infrastructure cannot support mobile services in the same frequency range. These frequency bands may be Universal Mobile Telecommunication Systems (UMTS) frequency bands, GSM frequency bands, or other frequency bands used in different communication technologies, such as, for example, cellular digital packet data (CDPD), general packet radio service (GPRS), enhanced data rates for GSM evolution (EDGE), 1 times radio transmission technology (1×RTT), evaluation data optimized (EVDO), high-speed downlink packet access (HSDPA), WiFi, WiMax, etc.

In the depicted embodiment, the first folded monopole structure 120 includes a first portion that extends away from the single RF feed 142, and a second portion that extends towards the single RF feed 142 and is coupled to the ground plane 140. In another embodiment, the first folded monopole structure 120 includes a first line having a path with one or more bends, and a second line having a return path with corresponding one or more bends. The return path follows the path with a gap between the first line and the second line. The gap may be equidistant over the length of the path and the return path. In another embodiment, the gap may have different distances over the length of the path and the return path. In FIG. 1, the first line has three bends and the second line has three corresponding bends, the first and second line forming a first arm segment that extends away from the single RF feed 142 and the ground plan 140. The first line has three more bends and the second line has three more corresponding bends that form a folded arm segment that extends towards the single RF feed 142 and the ground plane 140. The folded arm segment is shorter in length than the first arm segment. In another embodiment, the second folded monopole structure (e.g., parasitic folded monopole structure 130) includes a third line having a second path with at least one bend and a fourth line having a return path with at least one corresponding bend. The second return path follows the second path with a second gap between the third line and the fourth line. The gap may be equidistant over the distance of the length of the second folded monopole structure. In FIG. 1, the third line has two bends and the fourth line has two corresponding bends, the third and fourth lines forming folded arm.

In one embodiment, the first folded monopole structure 120 and the parasitic folded monopole structure 130 are coplanar. The structures may have the same height. For example, the first folded monopole structure 120 has a first height above the ground plane and the parasitic folded monopole structure 130 has the first height above the ground plane. Alternatively, the structure may have different heights. In FIG. 1, the parasitic folded monopole structure 130 is a folded arm structure that extends in a first direction from the ground plane towards the height of the dual-folded monopole antenna 100 and then bends, extending in an orthogonal direction along the top of the dual-folded monopole antenna 100. The first folded monopole structure 120 extends in the same first direction to a height less than the total height of the dual-folded monopole antenna 100 and bends extending in the same orthogonal direction for a distance. The first folded monopole structure 120 has another bend and extends in the first direction again towards the height of the dual-folded monopole antenna 100 and then bends, extending in the orthogonal direction along the top of the dual-folded monopole antenna 100. The first folded monopole structure 120 also includes a folded arm that extends towards the ground plane 140 for a specified distance and then bends, extending towards the RF feed 142 in the same orthogonal direction for another specified distance. Due to the bends in the first folded monopole structure 120 and the bends in the parasitic folded monopole structure 130, the structures are coplanar and have the same height above the ground plane 140.

In one embodiment, the dual-folded monopole antenna 100 provides two or more resonant modes. The resonant modes may cover at least one of the following: a first frequency band at 700 MHz, a second frequency band at 850 MHz, a third frequency band at 900 MHz, a fourth frequency band at 1.7 GHz, a fifth frequency band at 1.8 GHz, a sixth frequency band at 1.9 GHz, a seventh frequency band at 2.0 GHz, a eighth frequency band at 2.1 GHz, a ninth frequency band at 2.2 GHz, a tenth frequency band at 2.3 GHz, or an eleventh frequency band at 2.6 GHz. Modifications to the dimensions of the portions of the first folded monopole structure 120 and the parasitic folded monopole structure 130 may change the frequency and impedance matching of the dual-folded monopole antenna 100 as would be appreciated by one of ordinary skill in the art having the benefit of this disclosure.

In one embodiment, the dual-folded monopole antenna 100 includes a coupling portion 160 coupled to the first folded monopole structure 120. The coupling portion 160 is configured to increase coupling between the first folded monopole structure 120 and the parasitic folded monopole structure 130. The coupling portion is configured to provide impedance matching between the first folded monopole structure 120 and the parasitic folded monopole structure 130 and the RF feed 142.

Figure 2:
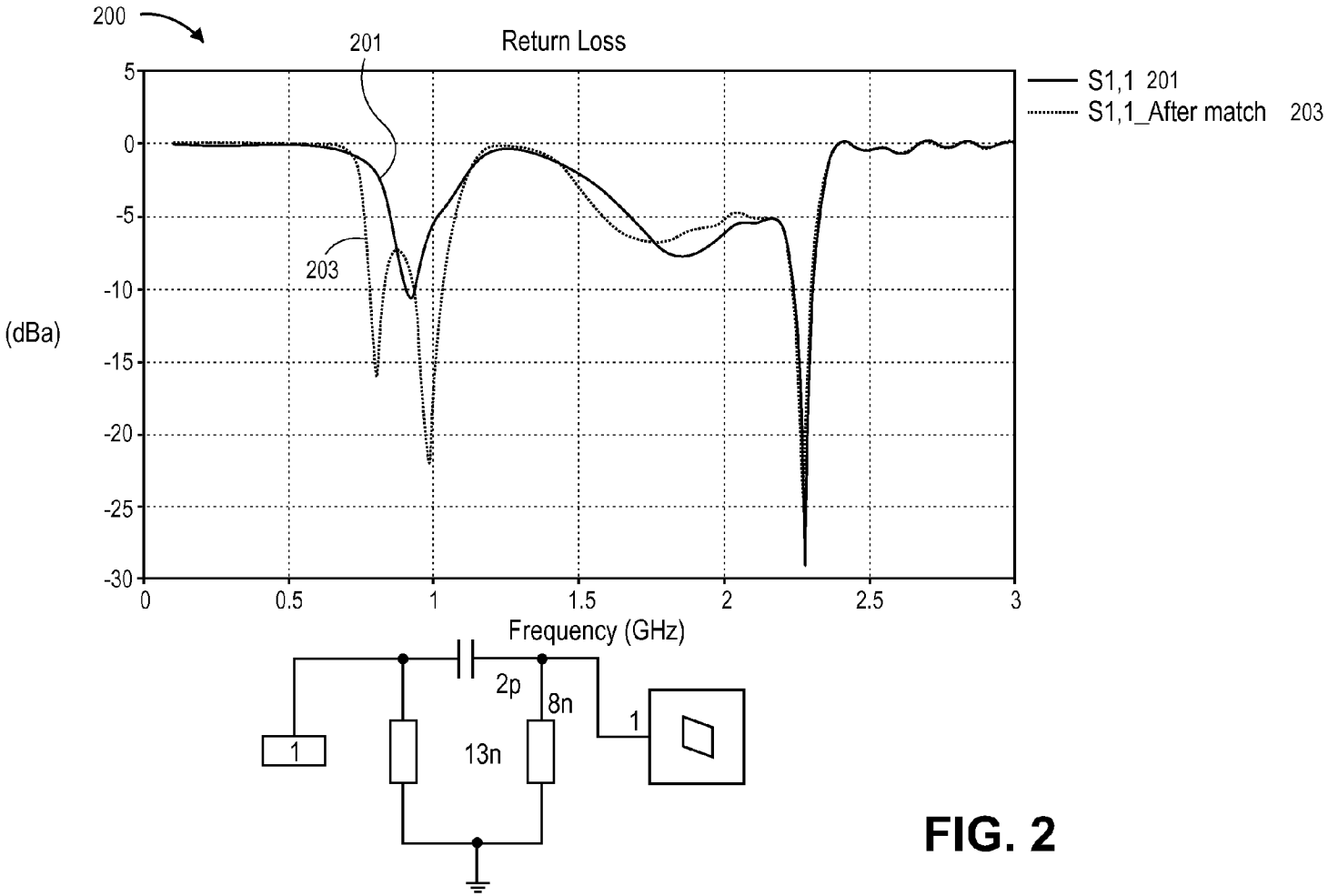
FIG. 2 is a graph of measured reflection coefficient of the dual-folded monopole antenna of FIG. 1 with and without an impedance matching circuit according to one embodiment.

FIG. 2 is a graph 200 of measured reflection coefficient of the dual-folded monopole antenna 100 of FIG. 1 with and without an impedance matching circuit 220 according to one embodiment. The graph 200 shows the measured reflection coefficient (also referred to S-parameter or |S11|) 201 of the structure of the dual-folded monopole antenna 100 of FIG. 1 without the impedance matching circuit 220. The graph 200 shows the measured reflection coefficient (|S1|_after match) 203 of the structure of the dual-folded monopole antenna 100 of FIG. 1 with the impedance matching circuit 220. The dual-folded monopole antenna 100 covers approximate 800 MHz to 2.4 GHz without circuit 220 and covers approximately 700 MHz to 2.4 GHz with circuit 220. Without the impedance matching circuit 220, the dual-folded monopole antenna 100 provides a first resonant mode centered at approximately 900 MHz, a second resonant mode centered at approximately 1.8 GHz, and a third resonant mode centered at approximately 2.3 GHz. With impedance matching circuit 220, the dual-folded monopole antenna 100 provides a first resonant mode centered at approximately 800 MHz, a second resonant mode centered at approximately 1 GHz, a third resonant mode centered at approximately 1.7 GHz, a fourth resonant mode center at approximately 1.9 GHz and a fifth resonant mode center at approximately 2.3 GHz (or 2.69 GHz). In another embodiment, the dual-folded monopole antenna 100 is an ultra wideband antenna configured to cover 700 MHz to 1.2 GHz and 1.6 GHz to 2.7 GHz. As described herein, other resonant modes may be achieved.

In other embodiments, more or less than three or four resonant modes may be achieved as would be appreciated by one of ordinary skill in the art having the benefit of this disclosure. It should also be noted that the first, second, third, fourth and fifth notations on the resonant modes are not be strictly interpreted to being assigned to a particular frequency, frequency range, or elements of the dual-folded monopole antenna. Rather, the first, second, third, fourth and fifth notations are used for ease of description. However, in some instances, the first, second, third fourth and fifth are used to designate the order from lowest to highest frequencies. Alternatively, other orders may be achieved as would be appreciated by one of ordinary skill in the art having the benefit of this disclosure. In one embodiment, the dual-folded monopole antenna 100 can be configured for the LTE (700/2600), UMTS, GSM (850, 800, 1800, and 1900), GPS, and Wi-FI/Bluetooth frequency bands. In effect, the dual-folded monopole antenna 100 has frequencies between 700 MHz to 2.7 GHz. Conventional multiband antennas for mobile devices usually have a narrow bandwidth and can only cover 824 MHz to 960 MHz and 1710 MHz to 2170 MHz. Using the embodiments described herein with the dual-folded monopole antenna, low impedance variation is feasible over 700 MHz to 2.7 GHz frequency range. Hence, the embodiments described herein can be utilized in any application in the frequency range, like LTE (700/2600), UMTS, GSM (850, 900, 1800, and 1900), GPS, and WI-FI/Bluetooth. In another embodiment, the dual-folded monopole antenna 100 can be designed to operate in the following target bands: 1) Verizon LTE band: 746 to 787 MHz; 2) US GSM 850: 824 to 894 MHz; 3) GSM900: 880 to 960 MHz; 4) GSM 1800/DCS: 1.71 to 1.88 GHz; 5) US1900/PCS (band 2): 1.85 to 1.99 GHz; and 6) WCDMA band I (band 1): 1.92 to 2.17 GHz. These resonance bandwidths may be characterized by VNA measurements with about 6 dB bandwidth (BW). Alternatively, the dual-folded monopole antenna 100 can be designed to operate in different combinations of frequency bands as would be appreciated by one of ordinary skill in the art having the benefit of this disclosure. Alternatively, the dual-folded monopole antenna 100 can be configured to be tuned to other frequency bands as would be appreciated by one of ordinary skill in the art having the benefit of this disclosure.

As would be appreciated by one of ordinary skill in the art having the benefit of this disclosure, the total efficiency of the antenna can be measured by including the loss of the structure and mismatch loss. The efficiency of the antenna can be tuned for specified target bands. For example, the target band can be Verizon LTE band and the GSM850/900 band, and the dual-folded monopole antenna 100 can be tuned to optimize the efficiency for this band as well as for other bands, such as DCS, PCS, and WCDMA bands. The efficiency of the dual-folded monopole antenna may be optimized by adjusting dimensions of the 2D structure, the gaps between the elements of the structure, a distance between the RF feed 120 and the grounding points at the ground plane 140, or any combination thereof. Similarly, 3D structures can be modified in dimensions and gaps between elements to improve the efficiency in certain frequency bands as would be appreciated by one of ordinary skill in the art having the benefit of this disclosure. It should also be noted that the antennas described herein may be implemented with two-dimensional geometries, as well as three-dimensional geometries as described herein.

As illustrated in FIG. 2, the impedance matching circuit 220 illustrates two inductors and a capacitor. The output of the impedance matching circuit 220 is coupled to the RF feed 142. The input of the impedance matching circuit 220 may be coupled to an output of the modem or other antenna circuitry. In one embodiment, the impedance matching circuit 220 is disposed on a printed circuit board. In one embodiment, the capacitor has a value of 2 pF and the inductors have values of 13 nH and 8 nH. Alternatively, other capacitor or inductor values may be used as would be appreciated by one of ordinary skill in the art having the benefit of this disclosure.

Figure 3:
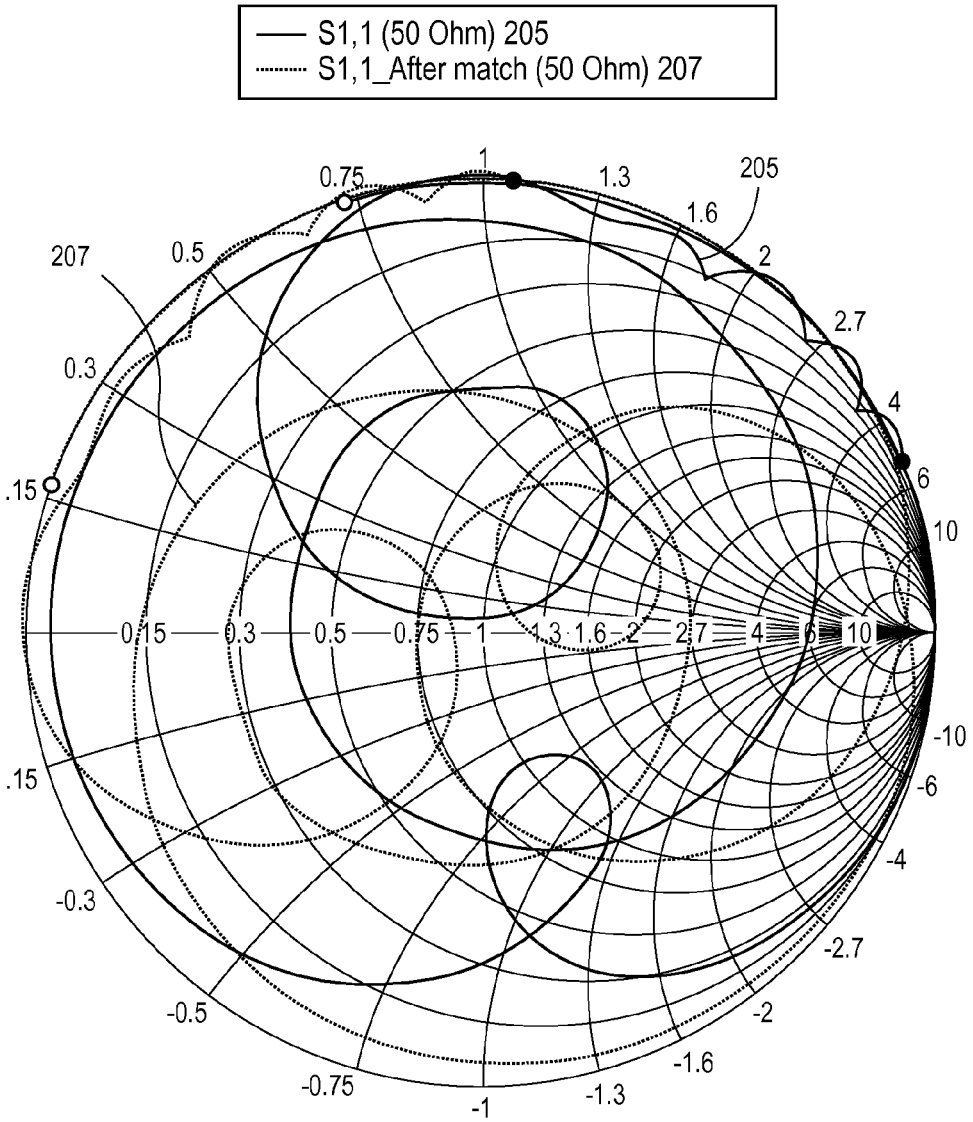
FIG. 3 is an impedance Smith chart illustrating the dual-folded monopole antenna of FIG. 1 with and without the impedance matching circuit of FIG. 2 according to embodiment.

FIG. 3 is an impedance Smith chart illustrating the dual-folded monopole antenna 100 of FIG. 1 with and without the impedance matching circuit 220 of FIG. 2 according to embodiment. The impedance Smith chart illustrates how the impedance and reactance behave at one or more frequencies. In particular, the line 205 corresponds to the impedance of the dual-folded monopole antenna 100 without the impedance matching circuit 220, and the line 207 corresponds to the impedance of the dual-folded monopole antenna 100 with the impedance matching circuit 220.

Figure 4:
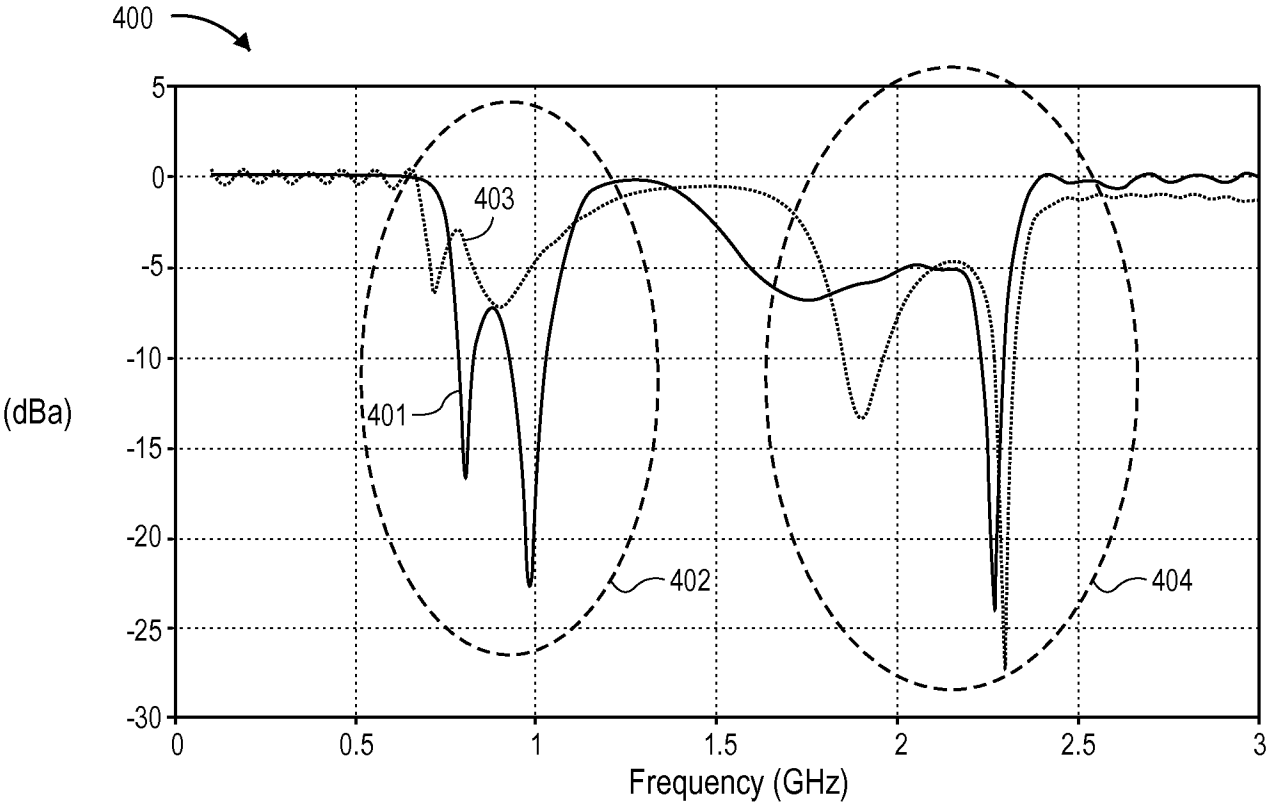
FIG. 4 is a graph of measured reflection coefficient of the dual-folded monopole antenna of FIG. 1 and measured reflection coefficient of another antenna according to one embodiment.

FIG. 4 is a graph 400 of measured reflection coefficient of the dual-folded monopole antenna 100 of FIG. 1 and measured reflection coefficient of another antenna according to one embodiment. The graph 400 shows the measured reflection coefficient (|S1|) 401 of the structure of the dual-folded monopole antenna 100 of FIG. 1 with the impedance matching circuit 220, as illustrated in graph 200 of FIG. 2. For comparison, the graph 400 also shows the measured reflection coefficient 403 of a multi-band antenna. The measured reflection coefficient 403 may be similar to the reflection coefficient described in co-pending application U.S. Ser. No. 13/211,138, filed Aug. 16, 2011, assigned to the common assignee. The multi-band antenna structure described in U.S. Ser. No. 13/211,138, may include a driven monopole that operates as a feeding structure to a T-monopole structure that is coupled to ground. This multi-band antenna structure may generate for resonant modes, two resonant modes in the lower band approximate at 700 MHZ and 850 MHz, and two resonant modes in the higher band approximately at 1.8 GHz and 2.1 GHz. As illustrated in FIG. 4, the dual-folded monopole antenna 100 may cover a larger range of frequencies, which may result in an increase in bandwidth, especially in the lower band 402. For example, the dual-folded monopole antenna 100 may cover frequencies between 70 700 MHz to 1 GHz in the low band 402, and 1.6 GHz to 2.3 GHz in the high band 404. Of course, other frequency ranges may be achieved as described herein.

Figure 5:
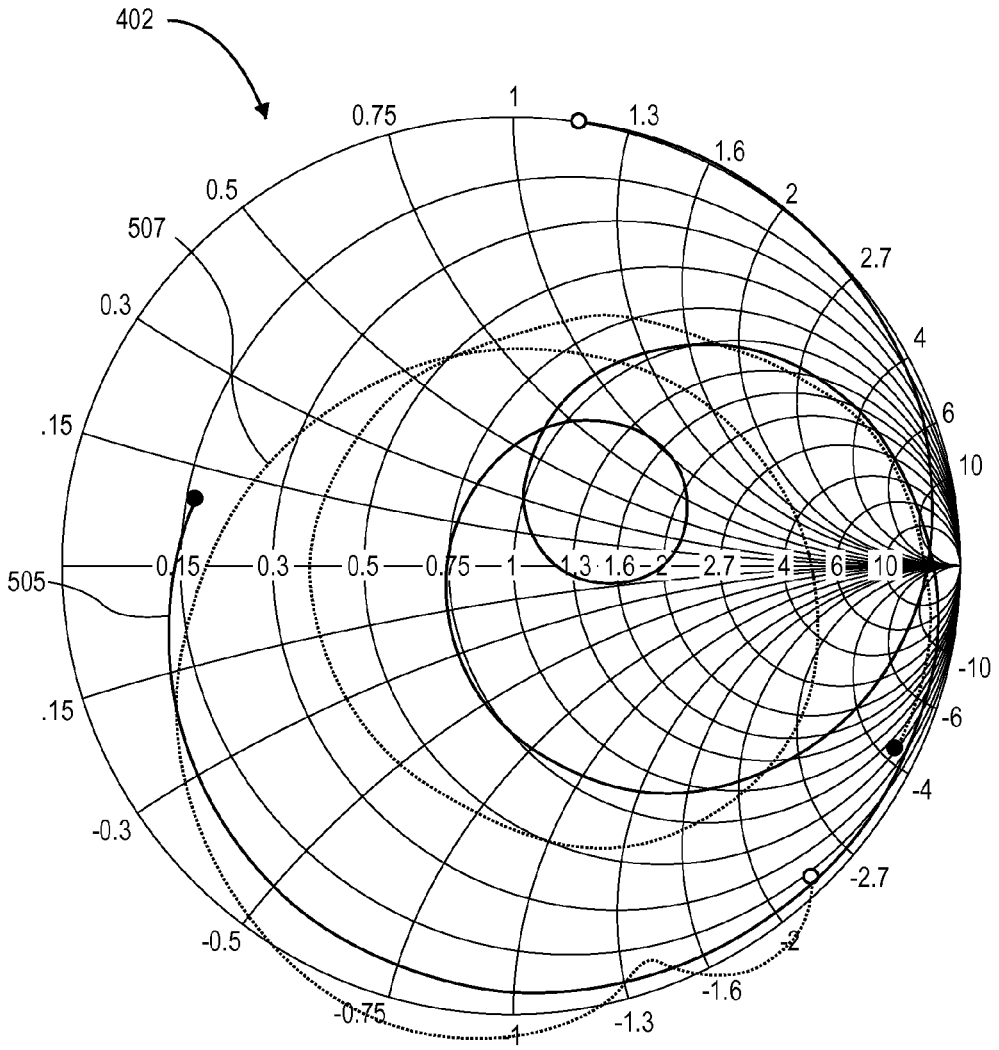
FIG. 5 is an impedance Smith chart illustrating the dual-folded monopole antenna and the other antenna of FIG. 4 at a low band according to embodiment.

FIG. 5 is an impedance Smith chart illustrating the dual-folded monopole antenna 100 and the other antenna of FIG. 4 at a low band 402 according to embodiment. The impedance Smith chart illustrates how the impedance and reactance behave at one or more frequencies. In particular, the line 505 corresponds to the impedance of the dual-folded monopole antenna 100 with the impedance matching circuit 220 in the low band 402, and the line 507 corresponds to the impedance of the other antenna in the low band 402.

Figure 6:
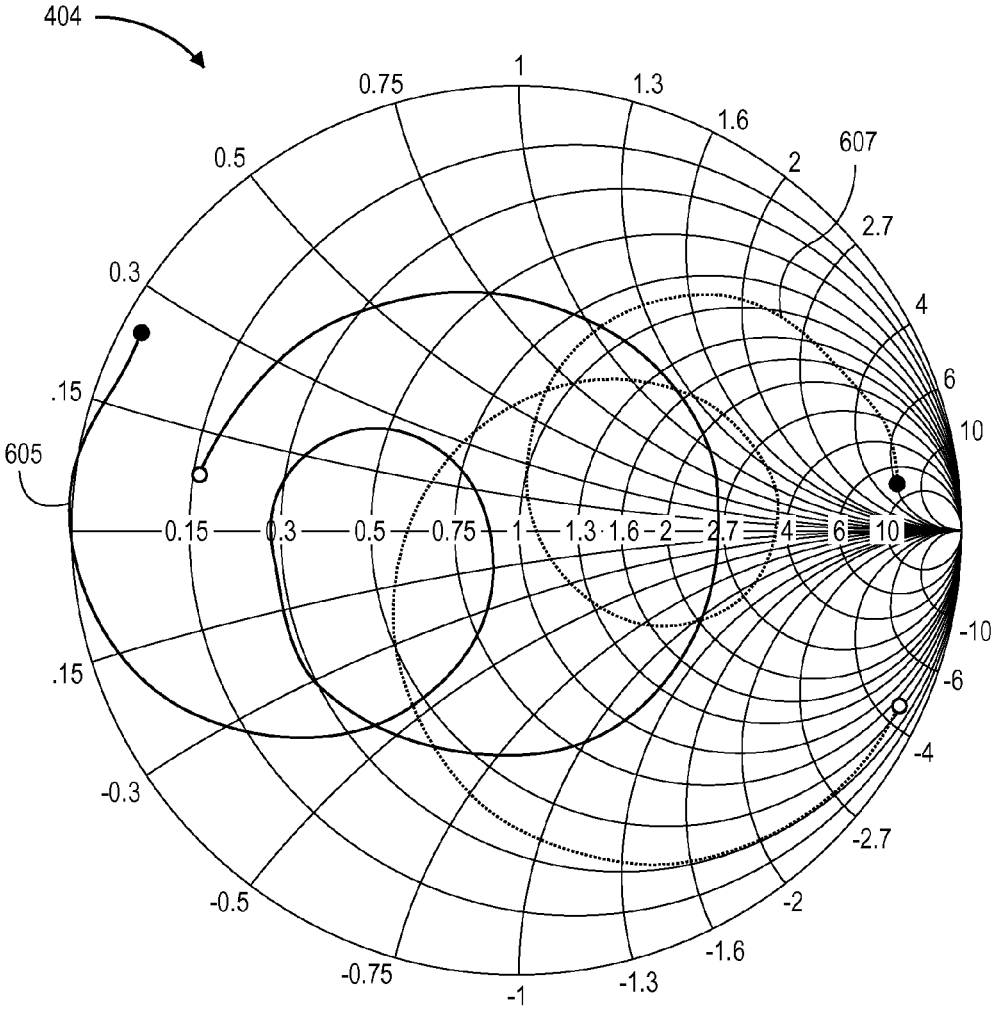
FIG. 6 is an impedance Smith chart illustrating the dual-folded monopole antenna and the other antenna of FIG. 4 at a high band according to embodiment.

FIG. 6 is an impedance Smith chart illustrating the dual-folded monopole antenna and the other antenna of FIG. 4 at a high band 404 according to embodiment. In particular, the line 605 corresponds to the impedance of the dual-folded monopole antenna 100 with the impedance matching circuit 220 in the high band 404, and the line 607 corresponds to the impedance of the other antenna in the high band 404.

FIGS. 7-16 illustrate various embodiments of the surface current of the dual-folded monopole antenna at different frequencies. These are illustrated and described as exemplary representations of the surface current using arrows. The difference in the sizes of the arrows, including the length and the width, are used to indicate the strength of the current as would be appreciated by one of ordinary skill in the art having the benefit of this disclosure. For example, at the low end of the range, the current may be as low as minimal or negligible current (e.g., 0.0 A/m) and as high as 128.217 A/m. Although the surface current is illustrated at specific frequencies, other frequencies may be used.

Figure 7:
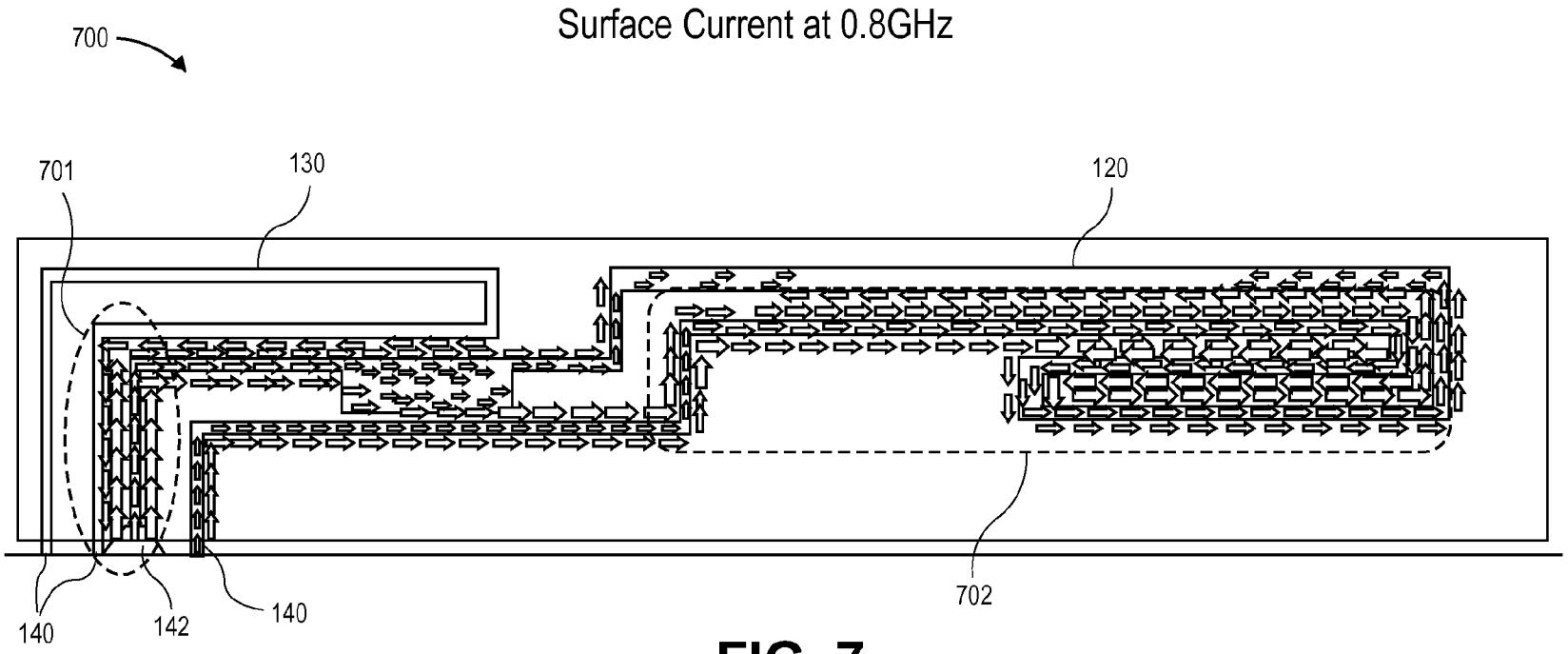
FIG. 7 illustrates an embodiment of surface current of the dual-folded monopole antenna at 800 MHz.

FIG. 7 illustrates an embodiment of surface current 700 of the dual-folded monopole antenna 100 at 800 MHz. The surface current 700 shows different areas of the dual-folded monopole antenna 100 has increased surface current as compared to the rest of the structure. In particular, areas 701 and 702 are areas of the structure in which there is an increased amount of current at 800 MHz. The first area 701 is located near the RF feed 142 and the grounding points at the ground plane 140 on both the first folded monopole structure 120 and the parasitic folded monopole structure 130. The second area 702 is located at the end of the first folded monopole structure 120, including the first arm and the folded arm of the first folded monopole structure 120. In one embodiment, the maximum surface current may be 84.1527 A/m at 800 MHz.

Figure 8:
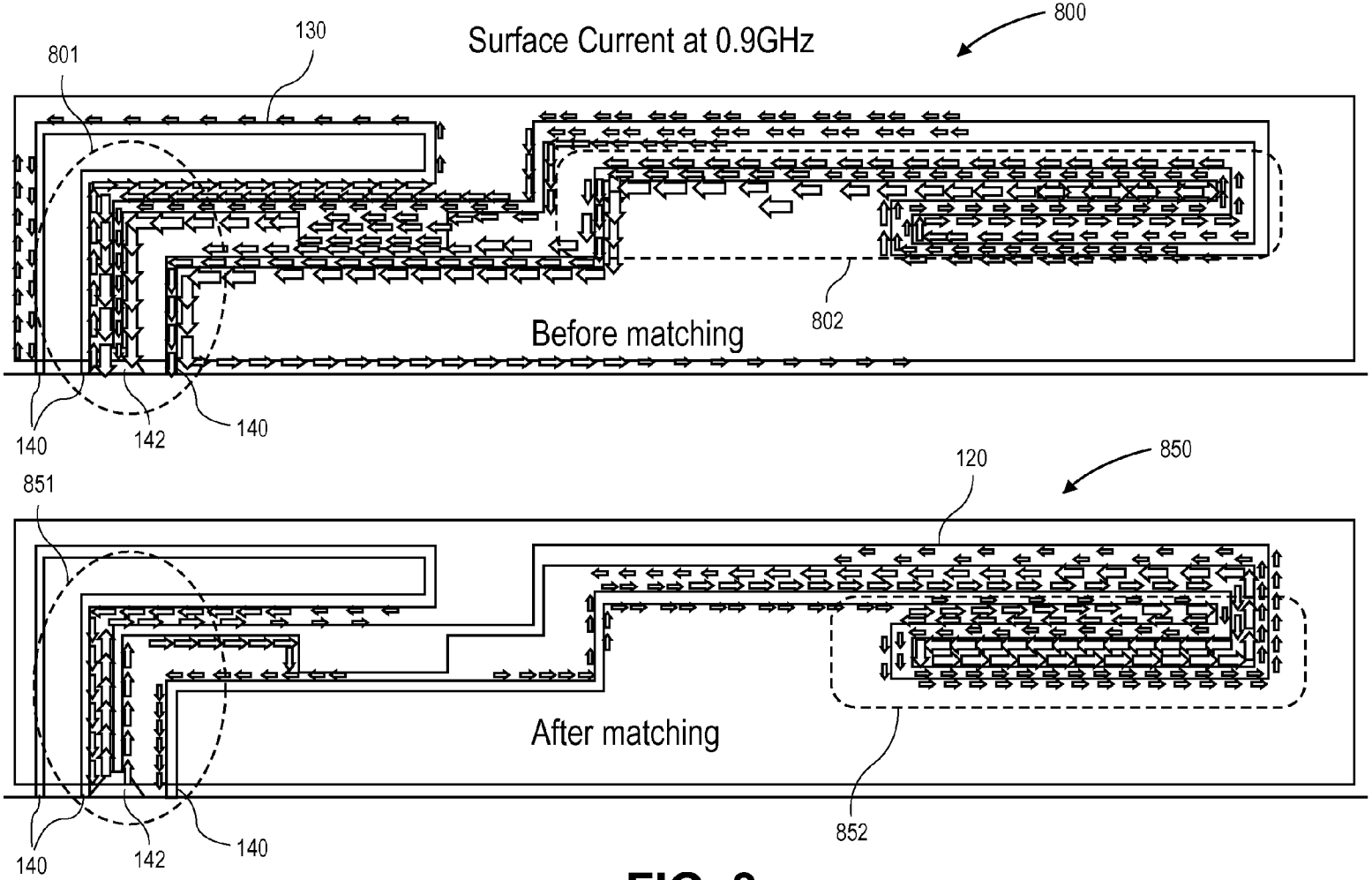
FIG. 8 illustrates an embodiment of surface currents of the dual-folded monopole antenna at 900 MHz before and after matching.

FIG. 8 illustrates an embodiment of surface currents 800 and 850 of the dual-folded monopole antenna 100 at 900 MHz before and after matching. The surface currents 800 and 850 show different areas of the dual-folded monopole antenna 100 having increased surface current as compared to the rest of the structure before and after impedance matching as described above with respect to FIG. 2. In particular, for surface current 800, the areas 801 and 802 are areas of the structure in which there is an increased amount of current at 900 MHz before matching. The first area 801 is located near the RF feed 142 and the grounding points at the ground plane 140 on both the first folded monopole structure 120 and the parasitic folded monopole structure 130. The second area 802 is located at the end of the first folded monopole structure 120, particularly at the first arm. Also, for the surface current 850, the areas 851 and 852 are areas of the structure in which there is an increased amount of current at 900 MHz after matching. The first area 851 is located near the RF feed 142 and the grounding points at the ground plane 140 on both the first folded monopole structure 120 and the parasitic folded monopole structure 130. The first area 851 has less current on the return path of the first folded monopole structure 120 than the first area 801. The second area 852 is located at the end of the first folded monopole structure 120, particularly at the folded arm. The second area 852 has less current on the first arm and more on the folded arm than the second area 802. In one embodiment, the maximum surface current may be 52.4944 A/m at 900 MHz.

Figure 9:
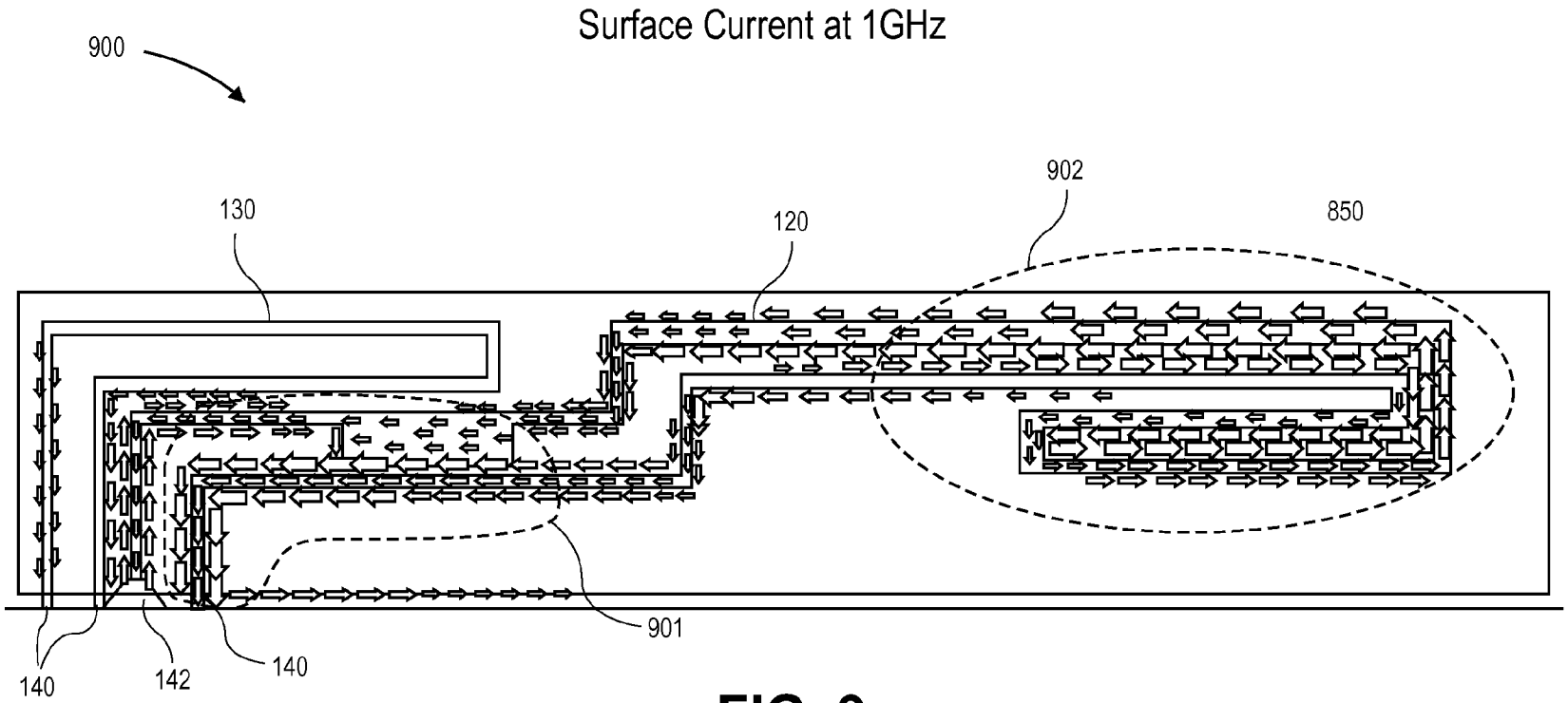
FIG. 9 illustrates an embodiment of surface current of the dual-folded monopole antenna at 1 GHz.

FIG. 9 illustrates an embodiment of surface current 900 of the dual-folded monopole antenna 100 at 1 GHz. The surface current 900 shows different areas of the dual-folded monopole antenna 100 has increased surface current as compared to the rest of the structure before and after impedance matching as described above with respect to FIG. 2. In particular, the areas 901 and 902 are areas of the structure in which there is an increased amount of current at 1 GHz. The first area 901 is located near the RF feed 142 and the grounding points at the ground plane 140 on the first folded monopole structure 120. There is also some current on the near the grounding point at the ground plane 140 and the parasitic folded monopole structure 130. The second area 902 is located at the end of the first folded monopole structure 120, particularly towards the end of the first arm and the folded arm. In one embodiment, the maximum surface current may be 59.0017 A/m at 1.0 GHz.

Figure 10:
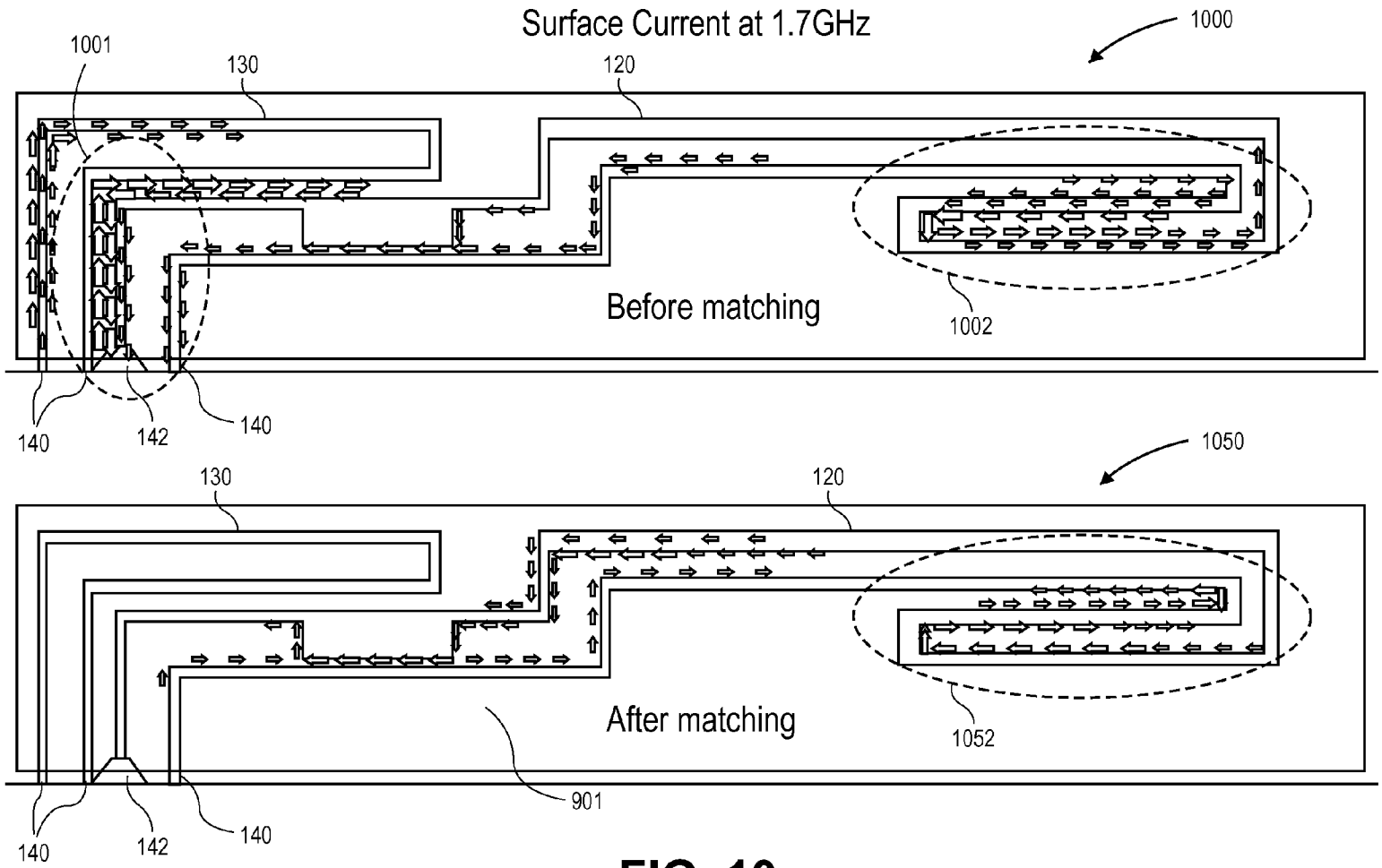
FIG. 10 illustrates an embodiment of surface currents of the dual-folded monopole antenna at 1.7 GHz before and after matching.

FIG. 10 illustrates an embodiment of surface currents 1000 and 1050 of the dual-folded monopole antenna 100 at 1.7 GHz before and after matching. The surface currents 1000 and 1050 show different areas of the dual-folded monopole antenna 100 having increased surface current as compared to the rest of the structure before and after impedance matching as described above with respect to FIG. 2. In particular, for the surface current 1000, the areas 1001 and 1002 are areas of the structure in which there is an increased amount of current at 1.7 GHz before matching. The first area 1001 is located near the RF feed 142 and the grounding points at the ground plane 140 and mainly between the first folded monopole structure 120 and the parasitic folded monopole structure 130. The second area 1002 is located at the end of the first folded monopole structure 120, particularly at the folded arm. Also, for the surface current 1050, the area 1052 is an areas of the structure in which there is an increased amount of current at 1.7 GHz after matching. The current near the RF feed and grounding points for the surface current 1050 is reduced compared to the surface current 1000. The second area 1052 is located at the end of the first folded monopole structure 120, particularly at the folded arm. The second area 1052 has more current on the folded arm than the second area 1002. In one embodiment, the maximum surface current may be 114.236 A/m at 1.7 GHz.

Figure 11:
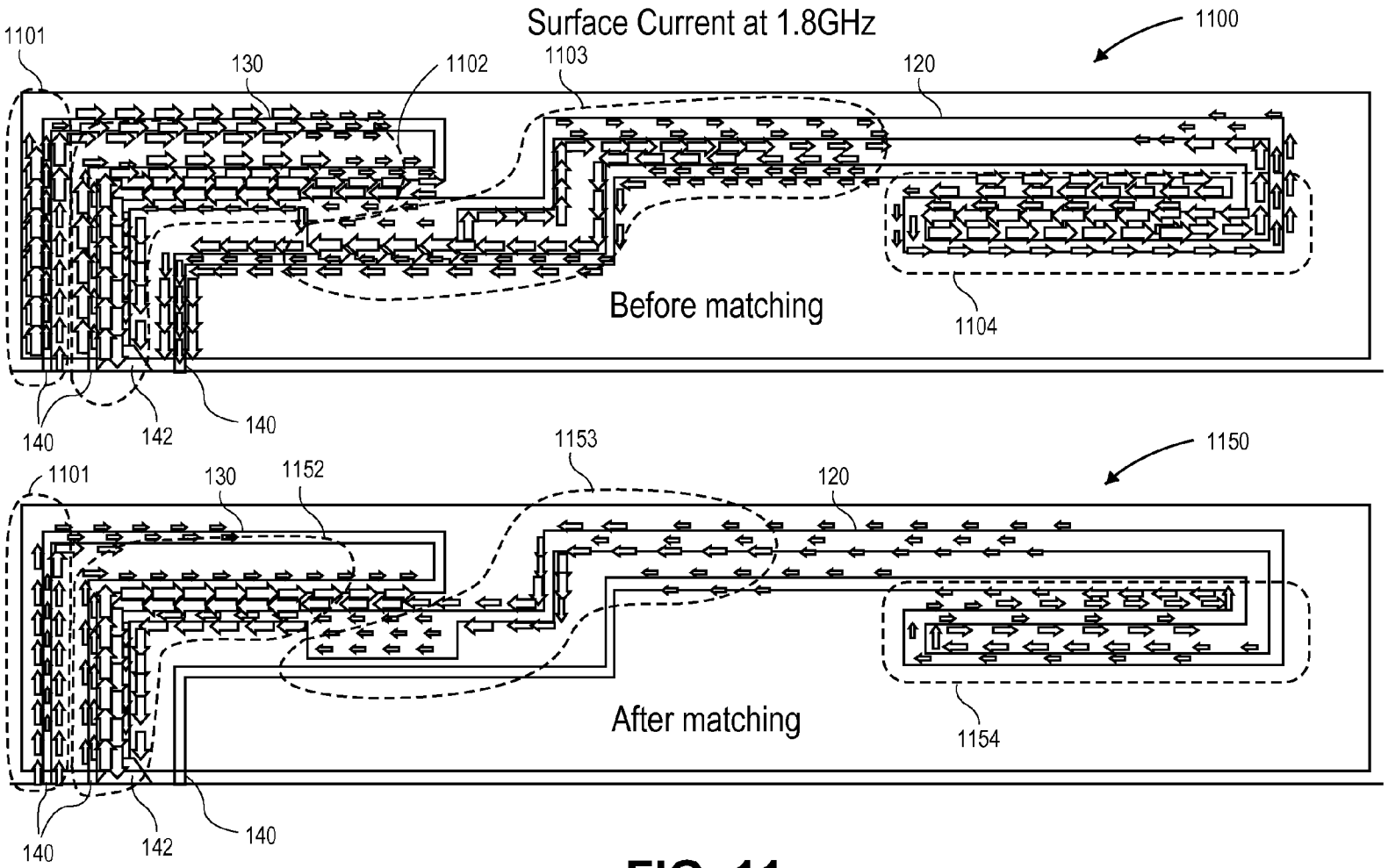
FIG. 11 illustrates an embodiment of surface currents of the dual-folded monopole antenna at 1.8 GHz before and after matching.

FIG. 11 illustrates an embodiment of surface currents 1100 and 1150 of the dual-folded monopole antenna 100 at 1.8 GHz before and after matching. The surface currents 1100 and 1150 show different areas of the dual-folded monopole antenna 100 having increased surface current as compared to the rest of the structure before and after impedance matching as described above with respect to FIG. 2. In particular, for the surface current 1100, the areas 1101-1104 are areas of the structure in which there is an increased amount of current at 1.8 GHz before matching. The first area 1101 is located near the RF feed 142 and the grounding points at the ground plane 140 and mainly on the parasitic folded monopole structure 130. The second area 1102 is also located near the RF feed 142 and the grounding points at the ground plane 140 and mainly on the first folded monopole structure 120. The third area 1103 is located in the middle of the first folded monopole structure 120, particularly at the second and third bends. The fourth area 1104 is located at the end of the first folded monopole structure 120, particularly at the folded arm. Also, for the surface current 1150, the areas 1151-1154 are areas of the structure in which there is an increased amount of current at 1.8 GHz after matching as compared to the rest of the structure. The surface current at area 1151 is reduced in current as compared to the area 1101, and the surface current at area 1152 is increased as compared to the area 1152. The surface current at area 1153 is reduced as compared to the area 1103, and the surface current at area 1154 is reduced as compared to the area 1104. In one embodiment, the maximum surface current may be 126.513 A/m at 1.8 GHz.

Figure 12:
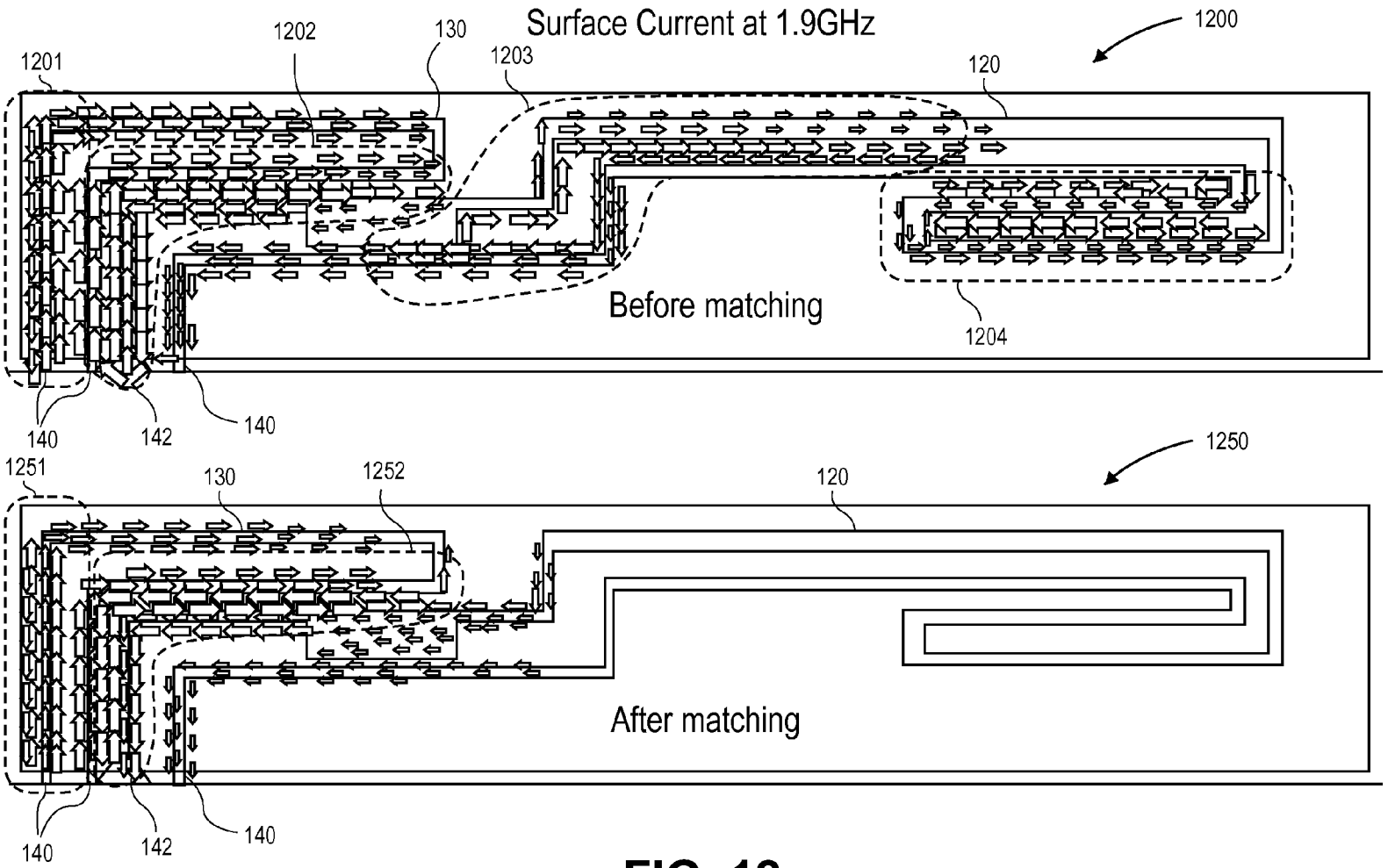
FIG. 12 illustrates an embodiment of surface currents of the dual-folded monopole antenna at 1.9 GHz before and after matching.

FIG. 12 illustrates an embodiment of surface currents 1200 and 1250 of the dual-folded monopole antenna 100 at 1.9 GHz before and after matching. The surface currents 1200 and 1250 show different areas of the dual-folded monopole antenna 100 having increased surface current as compared to the rest of the structure before and after impedance matching as described above with respect to FIG. 2. In particular, for the surface current 1200, the areas 1201-1204 are areas of the structure in which there is an increased amount of current at 1.9 GHz before matching. The first area 1201 is located near the RF feed 142 and the grounding points at the ground plane 140 and mainly on the parasitic folded monopole structure 130. The second area 1202 is also located near the RF feed 142 and the grounding points at the ground plane 140 and mainly on the first folded monopole structure 120 from the RF feed 142 and the first bend. The third area 1203 is located in the middle of the first folded monopole structure 120, particularly at the second and third bends. The fourth area 1204 is located at the end of the first folded monopole structure 120, particularly at the folded arm. Also, for the surface current 1250, the areas 1251-1252 are areas of the structure in which there is an increased amount of current at 1.9 GHz after matching as compared to the rest of the structure. The surface current at area 1251 is the same or slightly reduced as compared to the area 1201, and the surface current at area 1252 is the same or slightly reduced as compared to the area 1252. It should be noted that the surface current 1250 is reduced at areas that correspond to areas 1203 and 1204. In one embodiment, the maximum surface current may be 128.217 A/m at 1.9 GHz.

Figure 13:
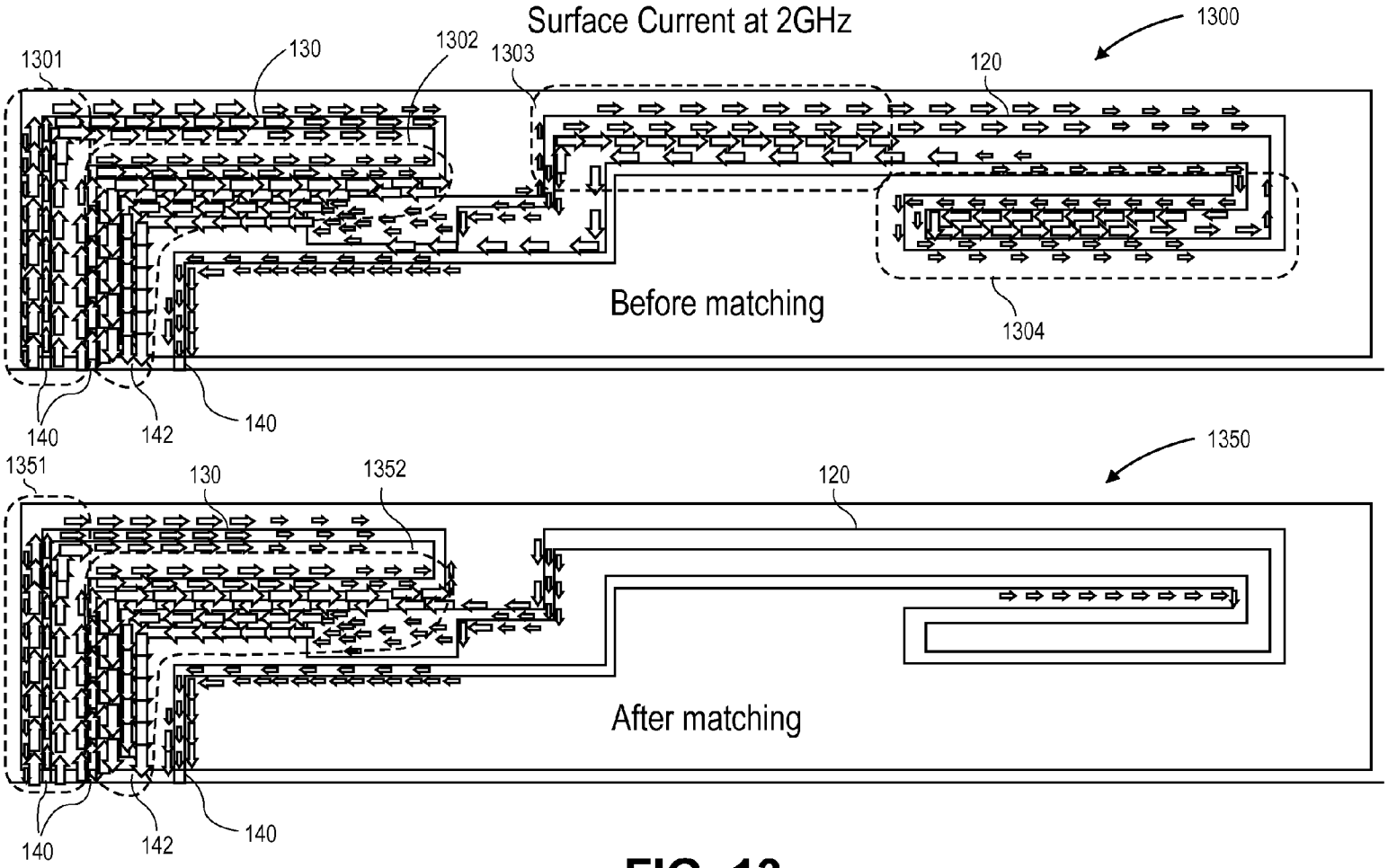
FIG. 13 illustrates an embodiment of surface currents of the dual-folded monopole antenna at 2.0 GHz before and after matching.

FIG. 13 illustrates an embodiment of surface currents 1300 and 1350 of the dual-folded monopole antenna 100 at 2.0 GHz before and after matching. The surface currents 1300 and 1350 show different areas of the dual-folded monopole antenna 100 having increased surface current as compared to the rest of the structure before and after impedance matching as described above with respect to FIG. 2. In particular, for the surface current 1300, the areas 1301-1304 are areas of the structure in which there is an increased amount of current at 2.0 GHz before matching. The first area 1301 is located near the RF feed 142 and the grounding points at the ground plane 140 and mainly on the parasitic folded monopole structure 130. The second area 1302 is also located near the RF feed 142 and the grounding points at the ground plane 140 and mainly on the first folded monopole structure 120 from the RF feed 142 and the first bend. The third area 1303 is located in the middle of the first folded monopole structure 120, particularly at the second and third bends. The fourth area 1304 is located at the end of the first folded monopole structure 120, particularly at the folded arm. Also, for the surface current 1350, the areas 1351-1352 are areas of the structure in which there is an increased amount of current at 2.0 GHz after matching as compared to the rest of the structure. The surface current at area 1351 is the same or slightly reduced as compared to the area 1301, and the surface current at area 1352 is the same or slightly reduced as compared to the area 1302. It should be noted that the surface current 1350 is reduced at areas that correspond to areas 1303 and 1304. In one embodiment, the maximum surface current may be 122.682 A/m at 2.0 GHz.

Figure 14:
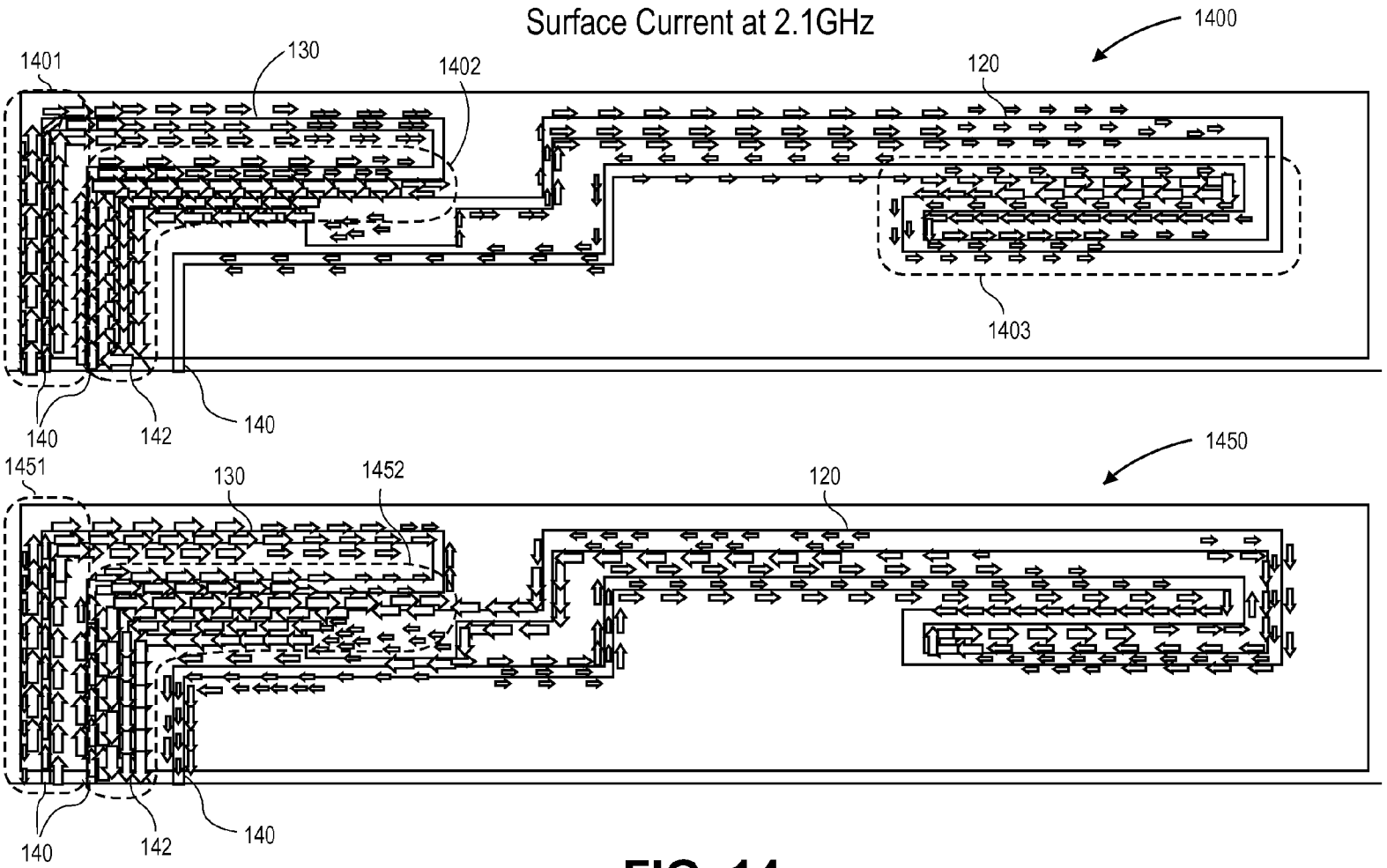
FIG. 14 illustrates an embodiment of surface currents of the dual-folded monopole antenna at 2.1 GHz before and after matching.

FIG. 14 illustrates an embodiment of surface currents 1400 and 1450 of the dual-folded monopole antenna 100 at 2.1 GHz before and after matching. The surface currents 1400 and 1450 show different areas of the dual-folded monopole antenna 100 having increased surface current as compared to the rest of the structure before and after impedance matching as described above with respect to FIG. 2. In particular, for the surface current 1400, the areas 1401-1403 are areas of the structure in which there is an increased amount of current at 2.1 GHz before matching. The first area 1401 is located near the RF feed 142 and the grounding points at the ground plane 140 and mainly on the parasitic folded monopole structure 130. The second area 1402 is also located near the RF feed 142 and the grounding points at the ground plane 140 and mainly on the first folded monopole structure 120 from the RF feed 142 and the first bend. The third area 1403 is located at the end of the first folded monopole structure 120, particularly at the folded arm. Also, for the surface current 1450, the areas 1451-1452 are areas of the structure in which there is an increased amount of current at 2.1 GHz after matching as compared to the rest of the structure. The surface current at area 1451 is the same or slightly increased as compared to the area 1401, and the surface current at area 1452 is the same or slightly increased as compared to the area 1402. It should be noted that the surface current 1450 is reduced at the area that correspond to the area 1403. In one embodiment, the maximum surface current may be 118.068 A/m at 2.1 GHz.

Figure 15:
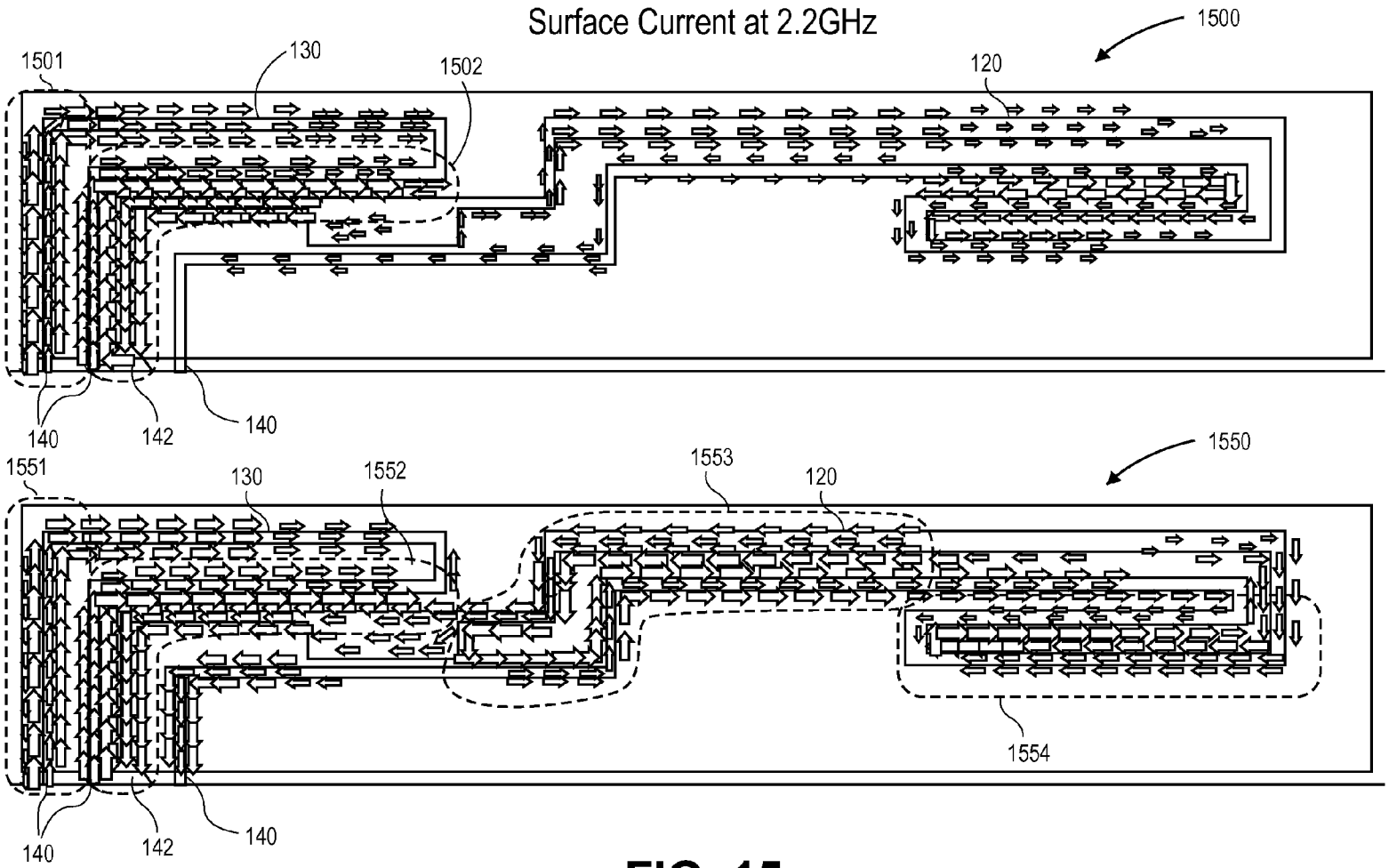
FIG. 15 illustrates an embodiment of surface currents of the dual-folded monopole antenna at 2.2 GHz.

FIG. 15 illustrates an embodiment of surface current 1500 and 1550 of the dual-folded monopole antenna 100 at 2.2 GHz before and after matching. The surface currents 1500 and 1550 show different areas of the dual-folded monopole antenna 100 having increased surface current as compared to the rest of the structure before and after impedance matching as described above with respect to FIG. 2. In particular, for the surface current 1500, the areas 1501-1502 are areas of the structure in which there is an increased amount of current at 2.2 GHz before matching. The first area 1501 is located near the RF feed 142 and the grounding points at the ground plane 140 and mainly on the parasitic folded monopole structure 130. The second area 1502 is also located near the RF feed 142 and the grounding points at the ground plane 140 and mainly on the first folded monopole structure 120 from the RF feed 142 and the first bend. Also, for the surface current 1550, the areas 1551-1554 are areas of the structure in which there is an increased amount of current at 2.2 GHz after matching as compared to the rest of the structure. The surface current at area 1551 is increased as compared to the area 1401 and extends further around the bend, and the surface current at area 1552 is the same or slightly increased as compared to the area 1502. It should be noted that the surface current 1550 is increased at additional areas 1553-1554. The area 1553 is located in the middle of the first folded monopole structure 120, particularly at the second and third bends. The area 1554 is located at the end of the first folded monopole structure 120, particularly at the folded arm. In one embodiment, the maximum surface current may be 114.554 A/m at 2.2 GHz.

Figure 16:
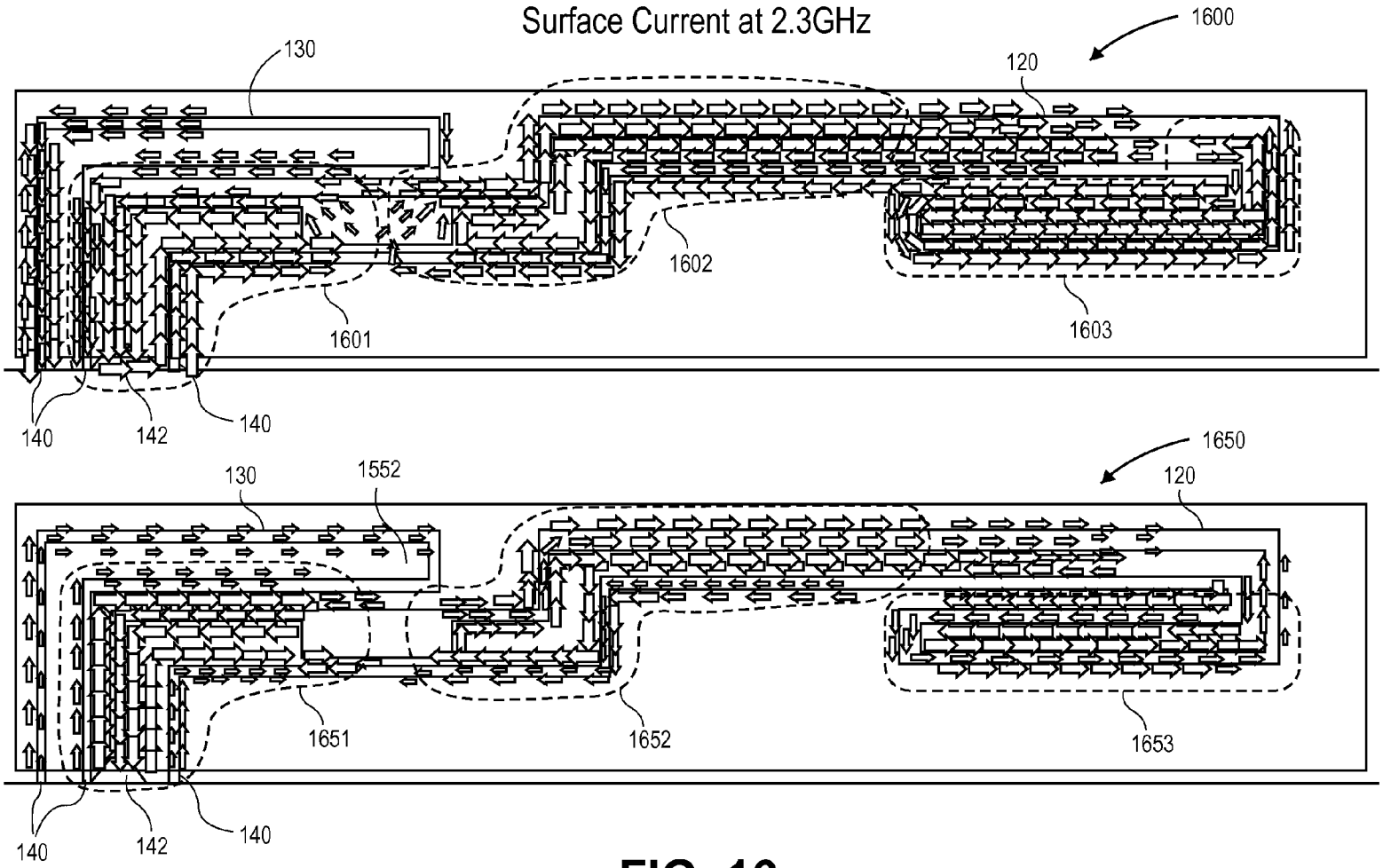
FIG. 16 illustrates an embodiment of surface currents of the dual-folded monopole antenna at 2.3 GHz before and after matching.

FIG. 16 illustrates an embodiment of surface currents 1600 and 1650 of the dual-folded monopole antenna 100 at 2.3 GHz before and after matching. The surface currents 1600 and 1650 show different areas of the dual-folded monopole antenna 100 having increased surface current as compared to the rest of the structure before and after impedance matching as described above with respect to FIG. 2. In particular, for the surface current 1600, the areas 1601-1603 are areas of the structure in which there is an increased amount of current at 2.3 GHz before matching. The first area 1601 is located near the RF feed 142 and the grounding points at the ground plane 140 and mainly on the first folded monopole structure 120 from the RF feed 142 and the first bend. The second area 1602 is located in the middle of the first folded monopole structure 120, particularly at the second and third bends. The third area 1603 is located at the end of the first folded monopole structure 120, particularly at the folded arm. Also, for the surface current 1550, the areas 1551-1553 are areas of the structure in which there is an increased amount of current at 2.3 GHz after matching as compared to the rest of the structure. The surface current at area 1551 is increased as compared to the area 1601, and the surface current at area 1652 is reduced as compared to the area 1602. The surface current at 1653 is reduced as compared to the area 1603. In one embodiment, the maximum surface current may be 112.728 A/m at 2.3 GHz.

Figure 17:
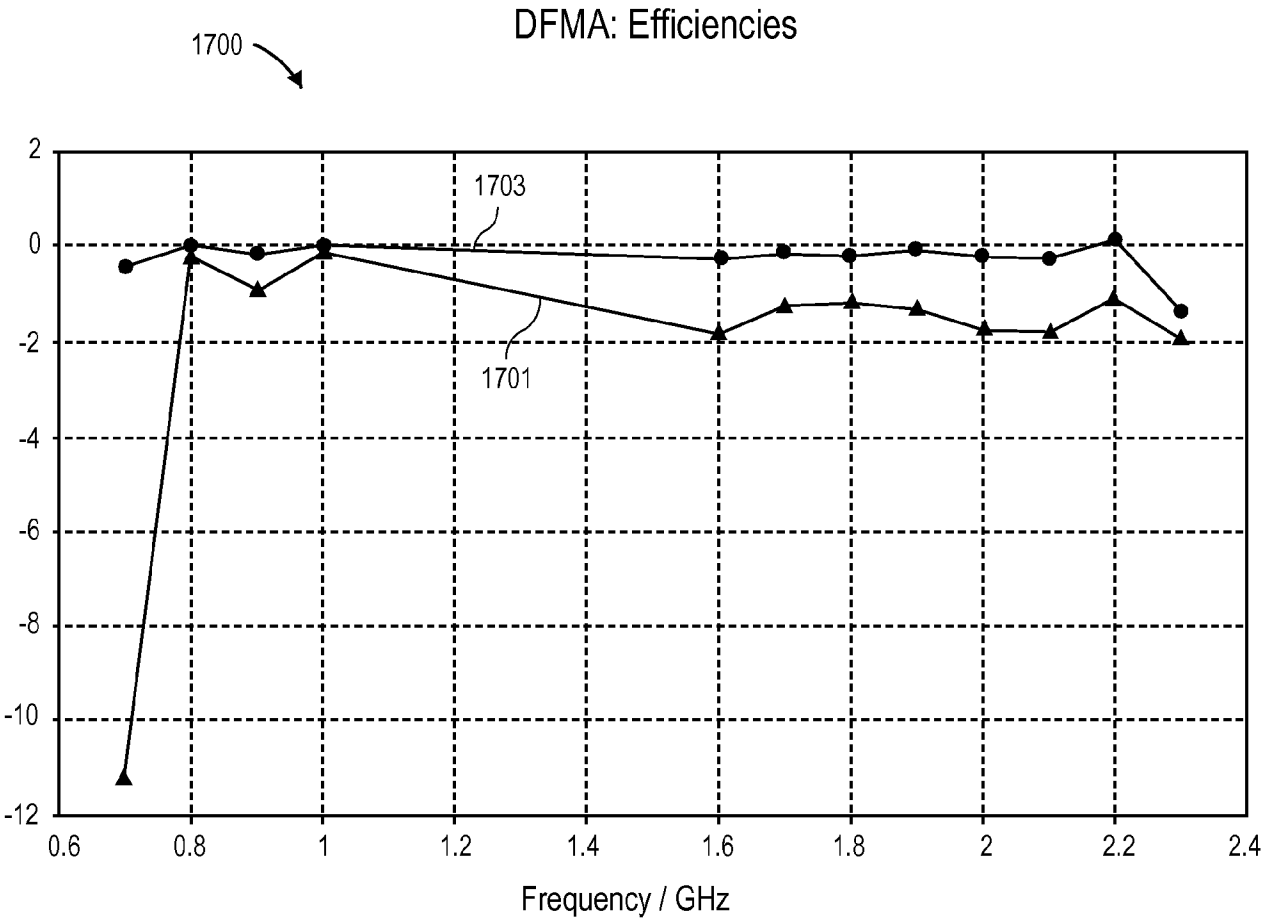
FIG. 17 is a graph of efficiencies of the dual-folded monopole antenna of FIG. 1.

FIG. 17 is a graph 1700 of radiation efficiencies of the dual-folded monopole antenna 100 of FIG. 1. The total efficiency 1701 of the antenna can be measured by including the loss of the structure and mismatch loss. The graph 1700 shows the total efficiency 1701 of the dual-folded monopole antenna 100. The efficiency 1701 is good between 700 MHz to 1 GHz and 1.7 to 2.3 GHz. The graph 1700 also shows the radiation efficiency 1703 of the dual-folded monopole antenna 100. The radiation efficiency 1703 is good between 700 MHz and 2.3 GHz.

Figure 18:
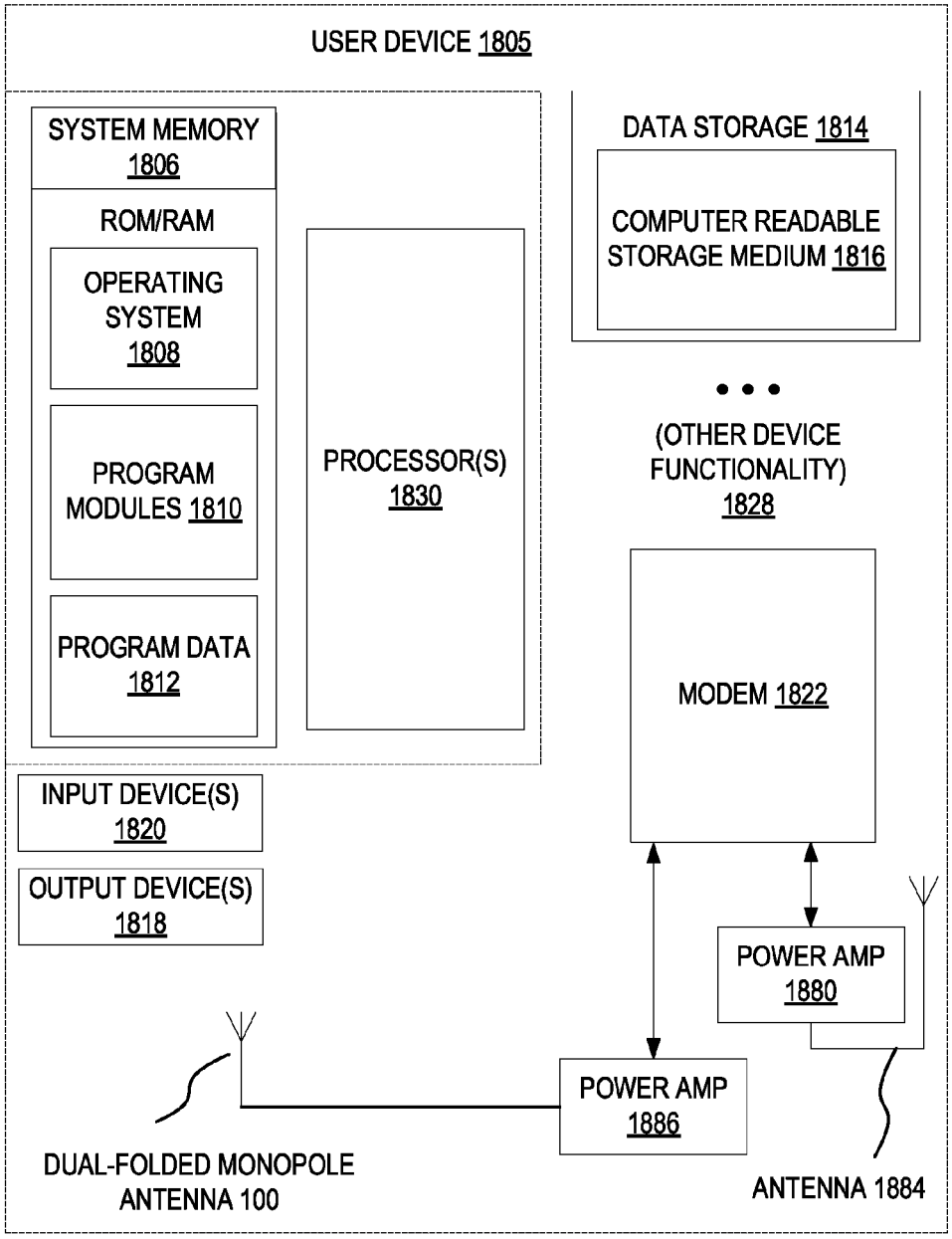
FIG. 18 is a block diagram of a user device having a dual-folded monopole antenna according to one embodiment.

FIG. 18 is a block diagram of a user device having a dual-folded monopole antenna 100 according to one embodiment. The user device 1805 includes one or more processors 1830, such as one or more CPUs, microcontrollers, field programmable gate arrays, or other types of processing devices. The user device 1805 also includes system memory 1806, which may correspond to any combination of volatile and/or non-volatile storage mechanisms. The system memory 1806 stores information, which provides an operating system component 1808, various program modules 1810, program data 1812, and/or other components. The user device 1805 performs functions by using the processor(s) 1830 to execute instructions provided by the system memory 1806.

The user device 1805 also includes a data storage device 1814 that may be composed of one or more types of removable storage and/or one or more types of non-removable storage. The data storage device 1814 includes a computer-readable storage medium 1816 on which is stored one or more sets of instructions embodying any one or more of the functions of the user device 1805, as described herein. As shown, instructions may reside, completely or at least partially, within the computer readable storage medium 1816, system memory 1806 and/or within the processor(s) 1830 during execution thereof by the user device 1805, the system memory 1806 and the processor(s) 1830 constituting computer-readable media. The user device 1805 may also include one or more input devices 1820 (keyboard, mouse device, specialized selection keys, etc.) and one or more output devices 1818 (displays, printers, audio output mechanisms, etc.).

The user device 1805 further includes a wireless modem 1822 to allow the user device 1805 to communicate via a wireless network (e.g., such as provided by a wireless communication system) with other computing devices, such as remote computers, an item providing system, and so forth. The wireless modem 1822 allows the user device 1805 to handle both voice and non-voice communications (such as communications for text messages, multimedia messages, media downloads, web browsing, etc.) with a wireless communication system. The wireless modem 1822 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WiFi, etc. In other embodiments, the wireless modem 1822 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 1805 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 1805 to communicate with other devices, such as other user devices, server computing systems, telephone devices, or the like. In addition to wirelessly connecting to a wireless communication system, the user device 1805 may also wirelessly connect with other user devices. For example, user device 1805 may form a wireless ad hoc (peer-to-peer) network with another user device.

The wireless modem 1822 may generate signals and send these signals to power amplifier (amp) 1880 or power amp 1886 for amplification, after which they are wirelessly transmitted via the dual-folded monopole antenna 100 or antenna 1884, respectively. Although FIG. 18 illustrates power amps 1880 and 1886, in other embodiments, a transceiver may be used to all the antennas 100 and 1884 to transmit and receive. The antenna 1884, which is an optional antenna that is separate from the dual-folded monopole antenna 100, may be any directional, omnidirectional, or non-directional antenna in a different frequency band than the frequency bands of the dual-folded monopole antenna 100. The antenna 1884 may also transmit information using different wireless communication protocols than the dual-folded monopole antenna 100. In addition to sending data, the dual-folded monopole antenna 100 and the antenna 1884 also receive data, which is sent to wireless modem 1822 and transferred to processor(s) 1830. It should be noted that, in other embodiments, the user device 1805 may include more or less components as illustrated in the block diagram of FIG. 18.

In one embodiment, the user device 1805 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the dual-folded monopole antenna 100 that operates at a first frequency band and the second wireless connection is associated with a second resonant mode of the dual-folded monopole antenna 100 that operates at a second frequency band. In another embodiment, the first wireless connection is associated with the dual-folded monopole antenna 100 and the second wireless connection is associated with the antenna 1884. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 1822 is shown to control transmission to both antennas 100 and 1884, the user device 1805 may alternatively include multiple wireless modems, each of which is configured to transmit/receive data via a different antenna and/or wireless transmission protocol. In addition, the user device 1805, while illustrated with two antennas 100 and 1884, may include more or fewer antennas in various embodiments.

The user device 1805 delivers and/or receives items, upgrades, and/or other information via the network. For example, the user device 1805 may download or receive items from an item providing system. The item providing system receives various requests, instructions, and other data from the user device 1805 via the network. The item providing system may include one or more machines (e.g., one or more server computer systems, routers, gateways, etc.) that have processing and storage capabilities to provide the above functionality. Communication between the item providing system and the user device 1805 may be enabled via any communication infrastructure. One example of such an infrastructure includes a combination of a wide area network (WAN) and wireless infrastructure, which allows a user to use the user device 1805 to purchase items and consume items without being tethered to the item providing system via hardwired links. The wireless infrastructure may be provided by one or multiple wireless communications systems, such as one or more wireless communications systems. One of the wireless communication systems may be a wireless fidelity (WiFi) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 1805.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1805 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1805 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

Figure 19:
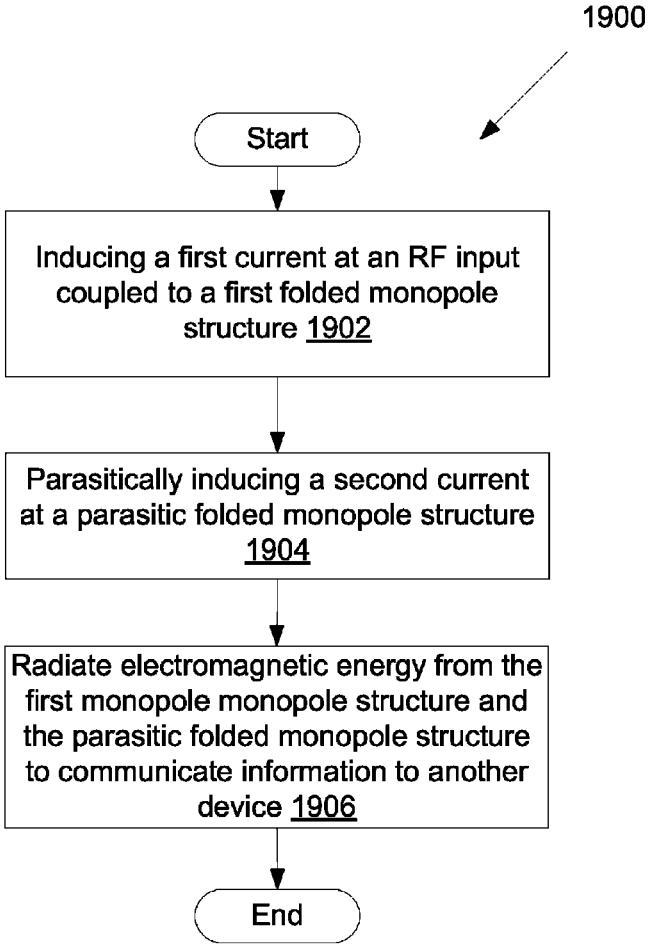
FIG. 19 is a flow diagram of an embodiment of a method of operating a user device having a dual-folded monopole antenna according to one embodiment.

FIG. 19 is a flow diagram of an embodiment of a method of operating a user device having a dual-folded monopole antenna 100 according to one embodiment. In method 1900, a first current is induced at a single radio frequency (RF) input coupled to a first folded monopole structure 120 (block 1902). In response, the antenna structure parasitically induces a parasitic folded monopole structure, the parasitic structure not being conductively connected to the first folded monopole structure (block 1904). In response to the induced currents, electromagnetic energy is radiated from the first folded monopole structure and the parasitic folded monopole structure to communicate information to another device (block 1906). The electromagnetic energy forms a radiation pattern. The radiation pattern may be various shapes as would be appreciated by one of ordinary skill in the art having the benefit of this disclosure.

In another embodiment, a current is induced at the RF input, which induces a surface current flow of the dual-folded monopole antenna, including a first folded monopole antenna and a second folded monopole antenna. The folded monopole antenna parasitically induces a current flow of the second folded monopole antenna. By inducing current flow at the parasitic folded monopole antenna, the parasitic folded monopole antenna increases the bandwidth of the dual-folded monopole antenna, providing additional two or more resonant modes to the resonant mode of the first folded monopole antenna. As described herein, the second folded monopole antenna is physically separated from the first folded monopole antenna by a gap.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. A user device, comprising:

a single radio frequency (RF) input;

a first folded monopole antenna coupled to the single RF input at a first end of the first folded monopole antenna and connected to a ground plane at a second end of the first folded monopole antenna, wherein the first folded monopole antenna defines a first gap between the first end and the second end;

a second folded monopole antenna connected to the ground plane at a first end of the second folded monopole antenna and at a second end of the second folded monopole antenna; and a coupling portion attached to the first folded monopole antenna and positioned within the first gap between a portion near the second end of the first folded monopole antenna and a third end of the second folded monopole antenna located distally from the first end and the second end of the second folded monopole antenna, wherein the second folded monopole antenna is parasitically coupled to the first folded monopole antenna via the coupling portion.

2. The user device of claim 1, wherein the user device communicates over frequencies between 700-960 MHz and 1.71-2.3 GHz.

3. The user device of claim 1, wherein the user device communicates over frequencies between 700-960 MHz and 1.71-2.69 GHz.

4. The user device of claim 1, wherein the first folded monopole antenna comprises:

a first portion that extends away from the single RF feed, wherein the coupling portion is coupled only to the first portion; and a second portion that extends towards the single RF feed and is coupled to the ground plane.

5. The user device of claim 1, wherein the first folded monopole antenna comprises:

a first line comprising a path with a first set of one or more bends; and a second line comprising a return path with a second set of one or more bends that correspond to the one or more bends of the first set, wherein the return path follows the path.

6. The user device of claim 5, wherein the first line and the second line form a first arm segment that extends away from the single RF feed and the ground plane.

7. The user device of claim 6, wherein the first line and the second line also form a folded arm segment that extends towards the single RF feed and the ground plane, wherein the folded arm segment is shorter in length than the first arm segment.

8. The user device of claim 5, wherein the second folded monopole antenna comprises:

a third line comprising a second path with a third set of one or more bends; and a fourth line comprising a second return path with a fourth set of one or more bends that corresponds to the one or more bends of the third set and that defines a second gap between the third and fourth line, wherein the second return path follows the second path.

9. The user device of claim 8, wherein the third line and fourth line form a second arm segment that follows a portion of a first arm segment with a third gap between the first line and the fourth line.

10. The user device of claim 8, wherein the first folded monopole antenna has a first height above the ground plane and the second folded monopole antenna has the first height above the ground plane.

11. The user device of claim 1, wherein the first folded monopole antenna and the second folded monopole antenna are to collectively provide a plurality of resonant modes.

12. The user device of claim 11, wherein the plurality of resonant modes cover at least one of the following: a first frequency band centered at 700 MHz, a second frequency band centered at 850 MHz, a third frequency band centered at 900 GHz, a fourth frequency band centered at 1.6 GHz, a fifth frequency band centered at 1.87 GHz, a sixth frequency band centered at 1.8 GHz, a seventh frequency band centered at 1.9 GHz, an eighth frequency band centered at 2.1 GHz, a ninth frequency band centered at 2.3 GHz, or a tenth frequency band centered at 2.6 GHz.

13. The user device of claim 1, wherein the coupling portion is to increase coupling between the first folded monopole antenna and the second folded monopole antenna, and wherein the coupling portion is to provide impedance matching between the first folded monopole antenna and the second folded monopole antenna and the single RF input.

14. The user device of claim 1, further comprising a wireless modem coupled to the single RF input, and wherein the first folded monopole antenna and the second folded monopole antenna are to radiate electromagnetic energy to communicate data from the wireless modem via the single RF input.

15. The user device of claim 14, further comprising at least one of a power amplifier or a transceiver coupled to the wireless modem and the single RF input.

16. The user device of claim 1, wherein the first folded monopole antenna and the second folded monopole antenna are disposed on an antenna carrier.

17. The user device of claim 1, wherein the first folded monopole antenna and the second folded monopole antenna are coplanar.

18. The user device of claim 1, wherein the first folded monopole antenna and the second folded monopole antenna are disposed on an antenna carrier disposed at least partially above a ground plane.

19. A method of operating a user device, comprising:

inducing a first current at a single radio frequency (RF) input connected to a first folded monopole structure of a dual-folded monopole antenna in which the first folded monopole structure defines a gap between a first end coupled to the single RF input and a second end connected to a ground plane;

in response, parasitically inducing a second current at a parasitic folded monopole structure of the dual-folded monopole antenna, wherein the parasitic folded monopole structure comprises a first end and a second end both connected to the ground plane, wherein the parasitic folded monopole structure is parasitically coupled to the first folded monopole structure via a coupling portion attached to the first folded monopole structure within the gap and positioned between a portion near the second end of the first folded monopole structure and a third end of the parasitic folded monopole structure located distally from the first end and the second end of the parasitic folded monopole structure; and radiating electromagnetic energy from the first folded monopole structure and the parasitic folded monopole structure to communicate information to another device in response to the first and second currents.

20. The method of claim 19, wherein said inducing the first current and parasitically inducing the second current collectively provides a plurality of resonant modes.

21. The method of claim 20, wherein the plurality of resonant modes are to cover at least one of the following: a first frequency band centered at 700 MHz, a second frequency band centered at 850 MHz, a third frequency band centered at 900 MHz, a fourth frequency band centered at 1.6 GHz, a fifth frequency band centered at 1.87 GHz, a sixth frequency band centered at 1.8 GHz, a seventh frequency band centered at 1.9 GHz, an eighth frequency band centered at 2.1 GHz, a ninth frequency band centered at 2.3 GHz, or a tenth frequency band centered at 2.6 GHz.

* * * * *